US011473881B2

(12) United States Patent
King

(10) Patent No.: US 11,473,881 B2
(45) Date of Patent: Oct. 18, 2022

(54) SHOOTING TARGET WITH AUDIBLE FEEDBACK

(71) Applicant: REAPER TRAINING SYSTEMS LLC, San Diego, CA (US)

(72) Inventor: James N. King, Orem, UT (US)

(73) Assignee: REAPER TRAINING SYSTEMS LLC, San Diego, CA (US)

( * ) Notice: Subject to any disclaimer, the term of this patent is extended or adjusted under 35 U.S.C. 154(b) by 0 days.

(21) Appl. No.: 16/999,720

(22) Filed: Aug. 21, 2020

(65) Prior Publication Data

US 2021/0063123 A1 Mar. 4, 2021

Related U.S. Application Data

(60) Provisional application No. 62/962,115, filed on Jan. 16, 2020, provisional application No. 62/891,862, filed on Aug. 26, 2019.

(51) Int. Cl.
*F41J 5/24* (2006.01)

(52) U.S. Cl.
CPC ..... *F41J 5/24* (2013.01)

(58) Field of Classification Search
CPC ..... F41J 5/24
See application file for complete search history.

(56) References Cited

U.S. PATENT DOCUMENTS 4,373,733 A * 2/1983 Smith, Jr. ..... F41J 5/24 273/386
2017/0336179 A1* 11/2017 Brune ..... F41J 5/24
2018/0216921 A1* 8/2018 Daub ..... F41J 1/10

* cited by examiner

*Primary Examiner* — Jeffrey S Vanderveen
(74) *Attorney, Agent, or Firm* — NorthStar Law Group; Thomas J. Bassolino

(57) ABSTRACT

The present teachings generally include devices, systems, and methods for shooting targets, and more particularly, to shooting targets that can provide audible feedback for a user. For example, a shooting target may include a plurality of plates, where different plates are structurally configured to resonate and create different sounds when struck by a projectile (e.g., a bullet from a firearm). In this manner, a user can discern—via a sound report heard by the user—where a shooter has struck the shooting target. Further, one or more of the plurality of plates may mimic (e.g., through location and/or shape) anatomy of an animal. In this manner, a shooter can receive audible feedback regarding whether the shooter has struck certain anatomical areas that would likely disable an animal in a real-life, live-action, non-simulated scenario.

20 Claims, 16 Drawing Sheets

SHOOTING TARGET WITH AUDIBLE FEEDBACK

CROSS-REFERENCE TO RELATED APPLICATIONS

This application claims priority to U.S. Provisional Application No. 62/891,862 filed on Aug. 26, 2019 and U.S. Provisional Application No. 62/962,115 filed on Jan. 16, 2020, where each of the foregoing applications is hereby incorporated by reference herein in its entirety.

FIELD

The present disclosure generally relates to devices, systems, and methods for shooting targets, and more particularly, to shooting targets providing audible feedback for a user.

BACKGROUND

Shooting targets include objects in various forms and shapes that are typically used for firearms training and sport (e.g., pistol, rifle, shotgun, and the like), as well as for darts, target archery, crossbow shooting, and other non-firearm related, projectile-launching activities. Although many shooting targets exist, they generally do not provide a shooter (or spotter) with feedback, e.g., so that a shooter can gauge whether or where they have struck a target while situated at a particular shooting distance that may be relatively far from the target. For example, a typical shooting target may include a piece of paper or cardboard with a silhouette and/or bullseye included thereon, where it is often difficult for a shooter to visually observe whether or where they have struck the target while at shooting distance from the target, e.g., because the hole created by the projectile (e.g., bullet round) may be relatively small. In such instances, it is often only when the shooter and target are brought together that the shooter can learn whether they have been successful in hitting the target. While reactive targets exist (e.g., targets designed to move and/or bounce along the ground when hit, or explosive targets), these targets are often rudimentary and unsuitable for proper, sophisticated target training.

Further, many shooting targets are not anatomically correct—e.g., they do not accurately mimic animal anatomy (human or otherwise). Often, these targets include silhouettes of humans or other animals (e.g., deer) that have no depth, and lack proper proportion. Mannequins or the like similarly often lack proper proportion. Moreover, these types of targets also lack feedback for determining whether or where a shooter has struck these targets when at particular distances, and more specifically, whether a shooter has struck certain anatomy that would likely disable their target in a real-life, live-action, non-simulated scenario.

There remains a need for improved shooting targets.

SUMMARY

The present teachings generally include devices, systems, and methods for shooting targets, and more particularly, to shooting targets that can provide audible feedback for a user. For example, a shooting target may include a plurality of plates, where different plates are structurally configured to resonate and create different sounds when struck by a projectile (e.g., a bullet from a firearm). In this manner, a user can discern—via a sound report heard by the user— where a shooter has struck the shooting target. Further, one or more of the plurality of plates may mimic (e.g., through location and/or shape) anatomy of an animal. In this manner, a shooter can receive audible feedback regarding whether the shooter has struck certain anatomical areas that would likely disable an animal in a real-life, live-action, non-simulated scenario.

In an aspect, a shooting target disclosed herein may include a first target region including a first plate, the first plate structurally configured to resonate and create a first sound when struck by a projectile. The shooting target may also include a second target region distinct from the first target region and including a second plate, the second plate structurally configured to resonate and create a second sound when struck by the projectile, where each of the first sound and the second sound are within a range of human hearing, and where the second sound is audibly distinct to a human from the first sound.

Implementations may include one or more of the following features. One or more of the first plate and the second plate may be structurally configured to mimic anatomy of an animal through one or more of shape and location. The animal may be a human. The animal may be a non-human. The anatomy of the animal may be a vital organ of the animal. The vital organ may include one or more of a heart, a lung, and a brain. The anatomy of the animal may be a portion of a spine of the animal. The anatomy of the animal may be a portion of a pelvis of the animal. Each of the first target region and the second target region may correspond to an anatomical region of an animal. The anatomical region of the animal may include a location of one or more of an organ, a bone structure, and tissue. The first sound may have a first frequency and the second sound may have a second frequency different from the first frequency. The first frequency and the second frequency may be different by at least 3 hertz (Hz). The first sound may have a first amplitude and the second sound may have a second amplitude different from the first amplitude. The first amplitude and the second amplitude may be different by at least 1 decibel (dB). The first plate and the second plate may be made from the same material but have different shapes to create different sounds when struck by the projectile. The first plate and the second plate may be made from steel. The first plate and the second plate may be made from different materials selected to create different sounds when struck by the projectile. The first plate may be a first size and the second plate may be a second size, where a size difference between the first size and the second size creates different sounds when struck by the projectile. The shooting target may further include a stand, the stand including a plurality of slots structurally configured for receiving one or more of the first plate and the second plate therein. One or more of the first plate and the second plate may be removable and replaceable within one or more of the plurality of slots for reconfiguring the shooting target. The shooting target may further include a locking mechanism structurally configured to secure one or more of the first plate and the second plate to the stand. The shooting target may further include an ancillary target plate affixable to the stand. The ancillary target plate may be movable relative to the stand. The ancillary target plate may include a visual marking thereon. The shooting target may further include a base, where the stand is affixable to the base to stabilize the shooting target. The shooting target may further include one or more teeth disposed on the base, the one or more teeth structurally configured to secure the base in the ground at a substantially fixed location. The shooting target may further include a holder structurally configured to couple with at least a portion of a second target to position the second target adjacent to one or more of the first plate and the second plate. The second target may be made of a paper product. The second target may include one or more of a silhouette of an animal and a bullseye. The holder may define one or more voids structurally configured to receive a support structure of the second target. The shooting target may further include a third plate structurally configured to resonate and create a third sound when struck by the projectile, where the third sound is audibly distinct to a human from the first sound and the second sound. The third plate may be disposed in a third target region distinct from each of the first target region and the second target region, where each of the first target region, the second target region, and the third target region correspond to different anatomical regions of an animal such that striking the different anatomical regions with the projectile will make different sounds providing audible feedback to a user that the user has hit a certain region with the projectile. The projectile may be a bullet fired from a firearm.

In an aspect, a shooting target system disclosed herein may include: a base; a stand affixed to the base and including a plurality of slots thereon; a first plate disposed within at least a first slot of the plurality of slots of the stand, the first plate structurally configured to resonate and create a first sound when struck by a projectile; and a second plate disposed within a second slot of the plurality of slots of the stand, the second plate structurally configured to resonate and create a second sound when struck by a projectile, where each of the first sound and the second sound are within a range of human hearing, and where the second sound is audibly distinct to a human from the first sound.

Implementations may include one or more of the following features. The system may further include a second target coupled to one or more of the base and the stand, where the second target is disposed in front of the stand, and where the second target includes one or more of a silhouette of an animal and a bullseye thereon. The system may further include an ancillary target plate coupled with the stand. The plurality of slots may be structurally configured such that, when a plate is disposed therein, the plate has a front surface disposed at an angle relative to a central axis that traverses through the stand. The angle may be between 32 and 42 degrees, inclusive.

In an aspect, a method disclosed herein may include: affixing a stand of a shooting target to a base; affixing a first plate and a second plate to the stand, where the first plate is structurally configured to resonate and create a first sound when struck by a projectile and the second plate is structurally configured to resonate and create a second sound when struck by the projectile, where each of the first sound and the second sound are within a range of human hearing, and where the second sound is audibly distinct to a human from the first sound; shooting a first projectile and striking the first plate to create the first sound; receiving a first report including the first sound indicating that the first plate has been struck by the first projectile; shooting a second projectile and striking the second plate to create the second sound; and receiving a second report including the second sound indicating that the second plate has been struck by the second projectile.

Implementations may include one or more of the following features. The method may further include coupling a second target to one or more of the base and the stand, where the second target includes one or more of a silhouette of an animal and a bullseye thereon. The method may further include coupling an ancillary target to the stand. The first projectile and the second projectile may be the same type of bullet fired from a firearm.

These and other features, aspects, and advantages of the present teachings will become better understood with reference to the following description, examples, and appended claim(s).

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals generally identify corresponding elements.

DETAILED DESCRIPTION

Figure 1:
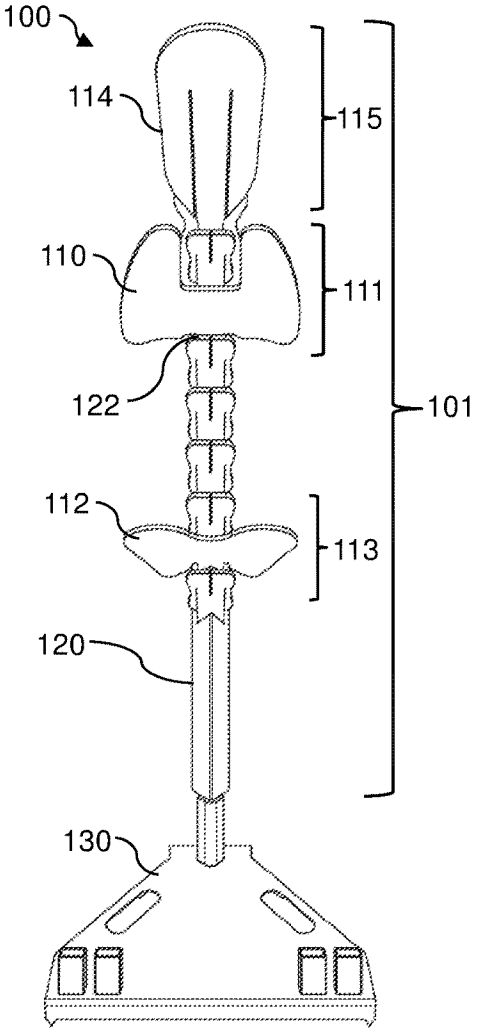
FIG. 1 shows a shooting target system, in accordance with a representative embodiment.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "about," "approximately," or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms unless specifically stated to the contrary.

In general, the devices, systems, and methods disclosed herein may relate to shooting targets, and more particularly, to shooting targets providing audible feedback for a user (e.g., a shooter, a spotter, a spectator, and so on) so that the user knows when and where a target has been struck. To this end, the shooting target may include a first target region, that, when struck by a projectile such as a bullet fired from a firearm, makes an audible sound (e.g., a first sound) that is discernable from a different audible sound (e.g., a second sound different from the first sound) that is made when a second target region (distinct from the first target region) is struck by the projectile. For example, the shooting target may include a plurality of plates, where one or more of the plates include a different shape, size, material, and/or material property such that different plates generate different audible sounds when struck by a projectile. Thus, using a plurality of different plates that create different audible sounds when struck by a projectile, a user can receive feedback that demonstrates to the user where (and if) the user has struck the shooting target with a fired (or otherwise launched or propelled) projectile.

Further, the plates (and, more generally, the shooting target) may be structurally configured to correspond to, and/or mimic the anatomy of an animal so that a user is provided with a relatively realistic, and thus a more useful, shooting target area. For example, the plates may be sized and shaped to resemble vital organs (and/or areas containing vital organs, and/or be disposed in locations that would contain vital organs) of human anatomy (e.g., lungs, head/brain, heart, and so forth) or other regions known to drop a human target (e.g., spine, pelvis, and so on) where one or more of these different regions (e.g., each of these different regions) may make a distinct sound when struck by a projectile. For example, areas or zones located where a head, lung, pelvis, and/or vertebrae would be located on an animal may each make different sounds when struck by a projectile.

Further, the plates may be movable and adjustable relative to a fixture of the shooting target (e.g., a base or a stand of the shooting target), thereby providing more flexibility for a user, as well as providing relatively easy assembly, disassembly, portability, and/or storage. This also or instead may provide a customizable shooting target. Further, one or more of the components (e.g., the plates) of the shooting target may be modular, for ease in moving/adjusting.

Also, a shooting target according to the present teachings may function with a second target—e.g., a paper, cardboard, foam, plastic, composite, or similar target and/or silhouette. For example, a shooting target may include a stand or a holder for a paper target to be placed thereon, e.g., in front of the plates as described herein.

It will be understood that the present teachings may be used in the context of firearms training, practice, recreational use, sport, and so forth. Thus, the "projectiles" and the like described herein may generally include a bullet (or other round) fired from a firearm. Such firearms may include without limitation one or more of small arms, handguns (e.g., revolvers and pistols), long guns, rifles, carbines, shotguns, submachine guns, automatic rifles, assault rifles, personal defense weapons, light machine guns, high-velocity firearms, large-caliber firearms (e.g., .50 caliber and the like), and so forth. However, the present teachings may also or instead be adapted for use with other projectiles and other devices for launching such projectiles, including without limitation, one or more of darts, arrows, pellets, ball projectiles (e.g., BBs), items thrown by a user (e.g., knives, axes, and so on), and so forth. Thus, the term "projectiles" shall be understood to include any of the foregoing unless explicitly stated to the contrary or otherwise clear from the context.

It will also be understood that, although described as "plates," which generally have a flat shape or surface, the plates as described herein may generally have any size or shape that can provide audible feedback to a user when struck by a projectile unless explicitly stated to the contrary or otherwise clear from the context.

Further, it will be understood that the "sound," "audible feedback," "report," or the like that is created when one or more portions of the shooting target are struck by a projectile can include one or more of a specific intensity, pitch, tone, volume, amplitude, frequency, overtone, harmonic, and so on. For example, a first portion of a shooting target may be structurally configured to create a first sound having a first tone when struck by a projectile, and a second portion (different from the first portion) may be structurally configured to create a second sound having a second tone (different from the first tone) when struck by a projectile. The first and second portions in this example, may correspond to certain anatomical regions of an animal, such as the relative location of specific organs, tissue, and/or bone structure. In this manner, the plates (or more generally, any portion of the shooting target) can act like a tuning fork or the like when struck by a projectile.

It will further be understood that the "sound," "audible feedback," "report," or the like that is created when one or more portions of the shooting target are struck by a projectile will be within a range of human hearing in preferred embodiments. The commonly stated range of human hearing is about 20 to 20,000 hertz (Hz), and thus the sounds created in the present teachings shall generally be within this range. More specifically, because humans are most sensitive to—meaning being able to discern at low intensities—frequencies between 2,000 and 5,000 Hz, the sounds created in the present teachings may generally be within this range. Further, different sounds created by the resonation of different plates being struck by a projectile shall be discernable and distinguishable by a human in preferred embodiments. Thus, by way of example, where these sounds differ in frequency, the frequency difference may be at least 3 Hz, and preferably much greater. And, where these sounds differ in amplitude, the amplitude difference may be at least 1 decibel (dB), and preferably greater. However, it will be generally understood that an intention of the present teachings is to provide a shooting target that resonates to create different sounds when different areas, regions, and/or plates are struck by a projectile, where these sounds are audible, and differentiable, to a human at typical shooting distances such as at least about 15 yards (about 13.7 meters). And, in some implementations, these sounds are audible and distinguishable by a human that is about 100-300 yards (91-275 meters) away, or greater. It will also be understood that the present teachings can be used in conjunction with a microphone and remote speakers (e.g., headphones) for use in relatively long-distance target practice and the like.

As stated above, a shooting target according to the present teachings may include two or more different plates (or more generally, two or more different portions or regions of the shooting target) that are structurally configured to provide different, distinct, human-discernable feedback (e.g., audible sounds) when struck by a projectile. The different feedback may be provided by the plates having different shapes, sizes, and/or locations on the shooting target, connections to portions of the shooting target, cutouts or grooves, accessories connected thereto or included thereon or therein, materials, material properties, coatings, and so on. For example, in certain implementations, the plates are each made of the same durable material such as metal (e.g., steel such as AR 500, AR 550, and AR 400 steel, and the like) where the shape and/or size of the plates being different provides a different sound when the plates are struck by a projectile. For example, the plates (as well as other portion(s) of the shooting target) may be formed of a steel, e.g., any within AR 36 through AR 550. Other materials may also or instead be used. By way of example, the plates (as well as other portion(s) of the shooting target) may include and/or be formed of a rubber material or the like.

Thus, a shooting target according to the present teachings may provide positive feedback to a user, e.g., different feedback for different regions of the shooting target mimicking vital zones. For example, each region mimicking a vital organ may produce a different tone when struck, so a user receives feedback that they (i) struck the target, and (ii) hit a certain location of the target.

An example scenario follows that shows a need for the present teachings. After setting up a cardboard/paper silhouette target on a shooting target according to the present teachings, practicing dry fire acquisition drills, loading a magazine into a weapon, a user may jerk the trigger meaning they hit the silhouette, but outside of center mass, hearing nothing. The user may then hit center mass, hearing a satisfying sound report. This may be an exhilarating feeling for a shooter, more so than without using the present teachings. On a traditional steel rack holding a cardboard/paper silhouette target, or using a steel silhouette of the prior art, the user may still experience a sound when hitting the target, but when hitting silhouette steel, whether it be a crucial center mass shot or an inaccurate shot, the sound report may be the same. The present teachings may fill this void by providing different, discernable sound reports when making a desirable shot as opposed to a less desirable shot. Thus, the present teachings may allow a user to know, almost immediately, every time a target is hit in certain regions, e.g., regions that yield a higher probability of stopping a threat or putting down a target.

The present teachings may be used as a stand-alone device, or a cardboard (or the like) silhouette or bullseye target can be added. This can improve accurate and effective shooting.

The present teachings may emphasize and train a user to hit effective, disabling shots, such as head shots, centerline throat to crotch shots, lung shots, and pelvic shots. These type of shots may have a higher probability of stopping a threat to a shooter as oppose to a "winging" shot or torso flesh wound shots.

The present teachings may include an easy no-tool assembly, featuring a simple slot design that allows a user to set up the target relatively quickly, e.g., in under two minutes.

The present teachings may include target plates and a mast made of about ⅜-inch AR 500 steel, which can be designed to take a .338 rifle round. The AR 500 steel may absorb and deflect missed rounds—e.g., rounds not hitting specific regions of interest such as those representing specific anatomy of an animal. The shooting target may include a sturdy, heavy-duty, adjustable base stand that can include teeth or the like allowing a secure, no-tilt footing, e.g., in gravel, dirt, sand, or the like. The base may also or instead include cutouts (e.g., 1-inch×2-inch cutouts) for adding a cardboard target stand in front of the shooting target and its plates. Other target mounts or stands may also or instead be used in conjunction with the shooting target as described herein.

The present teachings may include a locking rod or the like allowing for securement of one or more portions of the shooting target—e.g., the plates, a stand, a moving or non-moving target representing a hostage scenario, and/or moving or non-moving targets for competition shooting. Other locking or securing means may also or instead be included.

The present teachings may include ancillary targets—e.g., a hostage taker target plate, and/or a fixed position shooting angle target (e.g., nine slot) for increased shot challenges and proficiency. The present teachings may also or instead include a multi-plate shooting tree (e.g., six plates) that allows for increased challenges in shooting drills. One or more of these ancillary targets may be structurally configured similar to other plates as described herein—e.g., to resonate and create a distinct sound when struck by a projectile.

The plates, or other portions of the shooting target, may include a downward pitch, e.g., about a 40-degree forward pitch that allows for relatively safe downward deflection of projectile fragments. For example, in certain implementations, the pitch of one or more of the plates of a shooting target may be in the range of about 32-degrees to about 42-degrees relative to at least a portion of the stand of the shooting target (e.g., relative to a central axis that traverses through the stand, which may be substantially aligned with z-axis substantially normal to a surface upon which the shooting target rests). Other pitches and configurations (e.g., for safety, challenging a shooter, or otherwise) are also or instead possible. The stand may include a post or the like.

To accommodate a desired or predetermined pitch of one or more of the plates of a shooting target, the stand of the shooting target may include slots or the like defined or disposed thereon or therein. For example, the stand of the shooting target may include beveled grooves that are cut into or otherwise formed on the stand. More specifically, in certain implementations, the stand may define a plurality of such beveled grooves—in this manner, the stand can receive and accommodate a plurality of plates within one or more of the beveled grooves. This can permit a plethora of configurations for the shooting target when the plates are removable and replaceable within the grooves of the stand.

A shooting target according to the present teachings can keep a shooter engaged with its multiple options of unique shooting drills. For example, with a handgun, a user can hone-in and train on crucial shots. Adding a silhouette (e.g., cardboard or paper silhouette) can increase the challenge by engaging simulated threats while still receiving varied, multiple audible feedback for determining whether a shooter has hit an effective shot on the target (e.g., in a designated area) and not just a simple hit on the target. Adding a shooting tree and/or hostage taker plates (or the like) can further challenge a shooter, or multiple shooters, e.g., with speed and accuracy drills.

The present teachings may be used for long-range rifle shooting, where a shooter can learn—e.g., at a long-range distance such as 25 yards or more—that they have made an accurate shot, and which shot they have made because of the specific, different audible feedback provided by different areas of the shooting target.

FIG. 1 shows a shooting target system, in accordance with a representative embodiment. The system 100 may generally include a shooting target 101, one or more plates (e.g., a first plate 110, a second plate 112, a third plate 114, and so on), a stand 120, and a base 130. In general, and as discussed herein, one or more of the plates of the shooting target 101 may be structurally configured to resonate and create a particular sound when struck by a projectile such as a bullet discharged from a firearm, e.g., where the sound one plate creates is different from the sound another plate creates when struck by the same type of projectile, e.g., a bullet of the same caliber discharged from the same firearm.

For example, the shooting target 101 may include a first target region 111 including the first plate 110, where the first plate 110 is structurally configured to resonate and create a first sound when struck by a projectile. And the shooting target 101 may further include a second target region 113 distinct from the first target region 111 (e.g., disposed in a different location along the shooting target 101) and including the second plate 112, where the second plate 112 is structurally configured to resonate and create a second sound when struck by the projectile. As discussed herein, each of the first sound and the second sound may be within a range of human hearing, where the second sound is audibly distinct to a human from the first sound. In this manner, when a shooter fires a projectile that hits the first plate 110, the audible feedback would be distinct from audible feedback that a user would hear if they had hit a different region or plate such as the second plate 112. Advantageously, a user would then know precisely what region or plate they have struck even when disposed at a distance where they may not be able to see where they have struck the shooting target 101.

As shown in the figure, and as described throughout this disclosure, one or more of the plates of the shooting target 101 may resemble the anatomy of an animal, e.g., through their appearance and/or through their placement on the stand 120 of the shooting target 101 (i.e., through its location on the shooting target 101). For example, in an aspect, one or more of the first plate 110 and the second plate 112 is structurally configured to mimic the anatomy of an animal through one or more of its shape and/or its location. The animal may be a human or a non-human. The anatomy being mimicked may include an organ (e.g., a vital organ) of the animal—e.g., a heart, a lung, a brain, a liver, a kidney, a stomach, intestines, and so on. The anatomy of the animal may also or instead a portion of a pelvis of the animal, a portion of a spine of the animal, and so on. In this manner, one or more target regions of the shooting target 101 may correspond to an anatomical region of an animal—e.g., each of the first target region 111 and the second target region 113 may correspond to an anatomical region of an animal. Such an anatomical region of an animal may include a location of one or more of an organ, a bone structure, and tissue of the animal. Other anatomical regions are also or instead possible depending on the animal. By way of example, and as shown in the figure, the shooting target may generally mimic the shape of a human being, where the first plate 110 is situated and resembles the general shape of human lungs, and where the second plate 112 is situated and resembles the general shape of a human pelvis. This may be advantageous because these anatomical regions may be effective regions to "put down" a human target, such as an enemy combatant or attacker. Further, in addition to or instead of mimicking the anatomy of an animal, one or more of the plates of the shooting target 101 may resemble inanimate objects or parts thereof.

It will be understood that each plate of the shooting target 101 (and/or other portions of the shooting target 101, such as the stand 120 and the base 130) may create a unique sound relative to other plates (or other portions of the shooting target 101) when struck by a projectile. Alternatively, plates disposed in the same target region (or similar target regions) may create the same or similar sound, where this sound is different than the sound created by plates in a different target region. By way of example, all plates disposed in the first target region 111 may be structurally configured to resonate and create the same or similar sound when struck by a projectile that is audibly distinct (by a human) to a sound created by all plates disposed in the second target region 113. By way of further example, all plates that mimic vital organs may be structurally configured to resonate and create the same or similar sound when struck by a projectile that is audibly distinct (by a human) to a sound created by plates that mimic other portions of anatomy such as bone structure, tissue, non-vital organs, and so on. To this end, the shooting target 101 may be structurally configured to make a distinct "kill shot" sound when a region is struck that would likely kill the animal represented by the shooting target 101, as opposed to one or more different sounds that are created when other regions are struck by a projectile.

As discussed herein, the sound created when a plate or other portion of the shooting target 101 is struck by a projectile may be audibly distinct to a human user relative to sounds created when different plates or portions of the shooting target 101 are struck by the projectile. For example, the first sound created from the resonation of the first plate 110 may have a first frequency, and the second sound created from the resonation of the second plate 112 may have a second frequency different from the first frequency, where the first frequency and the second frequency may be different by at least 3 Hz. In this manner, the tone of the first sound may be different than the tone of the second sound. Also or instead, the first sound created from the resonation of the first plate 110 may have a first amplitude, and the second sound created from the resonation of the second plate 112 may have a second amplitude different from the first amplitude, where the first amplitude and the second amplitude may be different by at least 1 dB. In this manner, the volume or intensity of the first sound may be different from that of the second sound.

The plates of the shooting target 101 may be made from the same material or different materials. For example, in an aspect, the first plate 110 and the second plate 112 are made from the same material but have different shapes to create different sounds when struck by a projectile. By way of further example, the first plate 110 and the second plate 112 may be both made from steel as described herein. Also or instead, the plates may have the same or similar shape, but may be different sizes—e.g., the first plate 110 may be a first size and the second plate 112 may be a second size, where a size difference between the first size and the second size creates different sounds when struck by a projectile. Alternatively, in an aspect, the first plate 110 and the second plate 112 are made from different materials selected to create different sounds when struck by a projectile.

It will be understood that the discussion regarding the first plate 110 and the second plate 112 herein is provided by way of example, and in most embodiments of the present teachings, more plates are likely included on the shooting target 101. For example, and as shown in the figures included herein, a shooting target 101 may include a plate resembling a head, plates that resemble portions of a human spine, and so on. By way of further example, the shooting target 101 may further include a third plate 114 structurally configured to resonate and create a third sound when struck by a projectile, where the third sound is audibly distinct to a human from the first sound and the second sound of the first and second plates, respectively. Continuing with this example, the third plate 114 may be disposed in a third target region 115 distinct from each of the first target region 111 and the second target region 113. Each of the first target region 111, the second target region 113, and the third target region 115 may correspond to different anatomical regions of an animal such that striking the different anatomical regions with a projectile will make different sounds providing audible feedback to a user that the user has hit a certain region with the projectile—e.g., where the shooting target 101 is sized and shaped to resemble a human, and where the first target region 111 includes a chest region, the second target region 113 includes a pelvic region, and the third target region 115 is a head region. More plates and/or target regions are also possible as will be understood by a skilled artisan.

As discussed above, the system 100 may include a stand 120. The stand 120 may be affixed to the base 130 as shown in the figure. The stand 120 may include a plurality of slots 122 thereon. The plurality of slots 122 may be structurally configured for receiving one or more plates (or other portions) of the shooting target 101—e.g., one or more of the first plate 110 and the second plate 112 therein. In this manner, one or more of the plates may be removable, replaceable, and/or reconfigurable along the stand 120. For example, one or more of the first plate 110 and the second plate 112 may be removable and replaceable within one or more of the plurality of slots 122 for reconfiguring the shooting target 101. Also or instead, the system 100 may further include a locking mechanism structurally configured to secure the plates to the stand 120.

As discussed above, the system 100 may include a base 130 structurally configured to stabilize the shooting target 101 on a resting surface such as the ground. The stand 120 may be affixable to the base 130 (and/or removable and replaceable therein or thereon) to stabilize the shooting target 101. To enhance stability of the shooting target 101, the base 130 may include one or more teeth disposed thereon, where these teeth are structurally configured to secure the base 130 in the ground (e.g., in gravel, dirt, sand, mulch, or the like) at a substantially fixed location. The base 130 may also or instead include wheels, bearings, or the like to assist in moving and/or repositioning the system 100—e.g., wheels that engage the ground when the system 100 is tilted.

Figure 2:
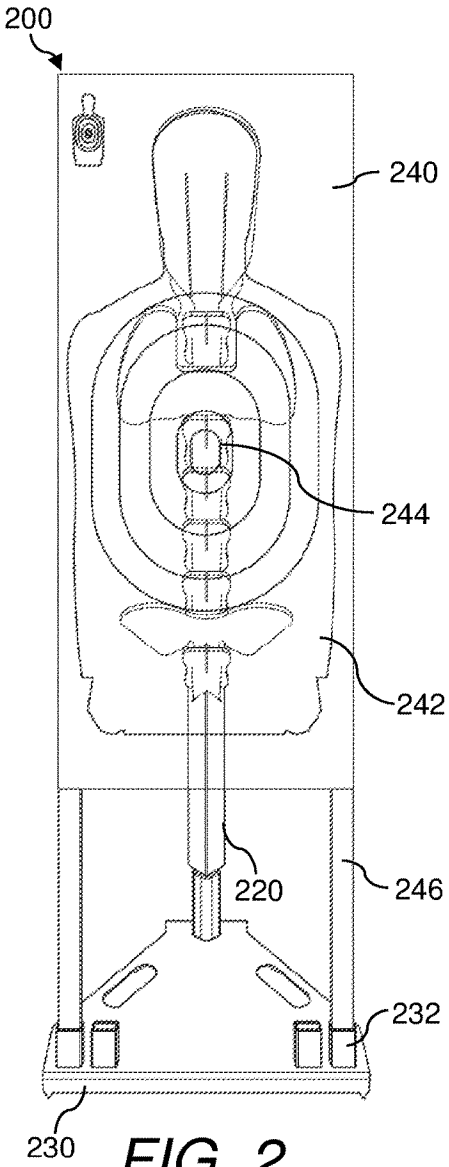
FIG. 2 shows a shooting target system with a second target, in accordance with a representative embodiment.

FIG. 2 shows a shooting target system with a second target, in accordance with a representative embodiment. The system 200 may be the same or similar to that shown and described above with reference to FIG. 1 (and thus may include any of the features described above), but may further include a second target 240 coupled to one or more of the base 230 and the stand 220. The second target 240 may be disposed in front of the stand 220 (i.e., between the shooting target and a shooter), e.g., so that a shooter striking the second target 240 with a projectile may also strike the shooting target behind the second target 240 when the projectile passes therethrough. As shown in the figure, the second target 240 may include one or more of a silhouette 242 of an animal and a bullseye 244 thereon. Other items are also or instead possible for inclusion on the second target 240 as will be understood by a skilled artisan. The second target 240 may be made of a paper product—e.g., paper, cardboard, or the like. In this manner, the second target 240 may simply be an off-the-shelf paper target or the like. Other materials and configurations are also or instead possible for the second target 240 as will be understood by a skilled artisan, such as foam, plastic, rubber, and the like.

To accommodate and couple with the second target 240, the system 200 may include a holder 232, which may be disposed on, defined by, or otherwise coupled to the base 230. The holder 232 may be structurally configured to couple with at least a portion of the second target 240 to position the second target 240 adjacent to a portion of the shooting target, such as one or more of the first plate and the second plate of the shooting target. For example, the holder 232 may define one or more voids structurally configured to receive a support structure 246 of the second target 240 therein.

Figure 3:
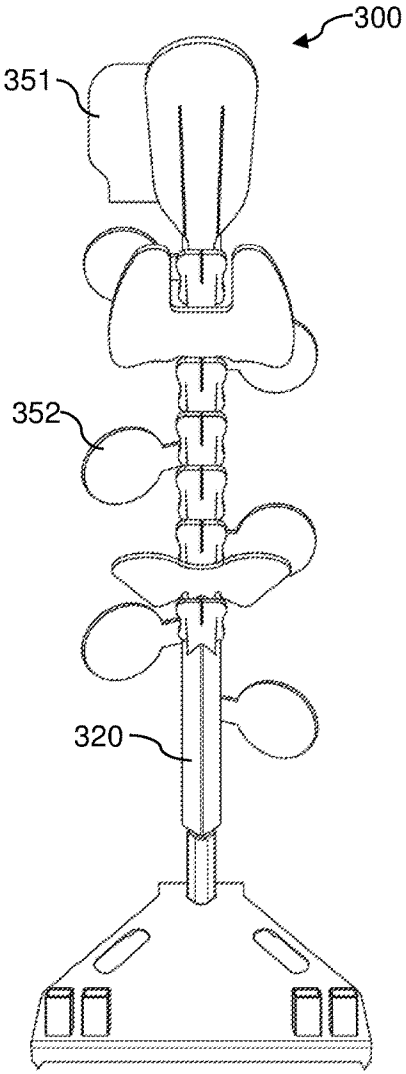
FIG. 3 shows a shooting target system with ancillary targets, in accordance with a representative embodiment.

FIG. 3 shows a shooting target system with ancillary targets, in accordance with a representative embodiment.

The system 300 may be the same or similar to that shown and described above with reference to FIGS. 1 and 2 (and thus may include any of the features described above), but may further include one or more ancillary target plates—e.g., a first ancillary target plate 351 and a plurality of second ancillary target plates 352. One or more of the ancillary target plates may be coupled with, and therefore may be affixable to, a portion of the system 300 or shooting target. For example, an ancillary target plate may be affixable to, and/or coupled with, the stand 320. Also or instead, an ancillary target plate may be coupled to another portion such as the base, one or more other plates of the shooting target, and so on. By way of example, a first ancillary target plate 351 may include a hostage taker style target plate, e.g., which can be located adjacent to or otherwise near one or more other plates of the shooting target, such as a plate that resembles a human head. By way of further example, a second ancillary target plate 352 may include a target of a shooting challenge tree or the like, e.g., such that the second ancillary target plate 352 is one of a plurality (e.g., six) of ancillary targets. Thus, one or more of the ancillary target plates may be part of a shooting game, challenge, or contest that can be conducted using the system 300. To this end, one or more of the ancillary target plates may be movable relative to the stand 320 or another portion of the shooting target, e.g., such that the ancillary target plates move (e.g., swing by rotating about an axis) when struck by a projectile thereby providing visual feedback to a user. Also or instead, one or more of the ancillary target plates may include a visual marking thereon—e.g., they may have a distinct color so that multiple shooters can partake in a shooting contest or the like (by way of example, where one side of the shooting target includes ancillary shooting targets that are a first color and another side of the shooting target includes ancillary shooting targets that are a second color). The visual marking may also or instead include other features such as one or more of symbols, letters, numbers, and the like. Additionally or alternatively, one or more of the ancillary target plates may be structurally configured to resonate and create a sound when struck by the projectile, where this sound can be unique to a particular ancillary target plate or a set of ancillary target plates.

Figure 4:
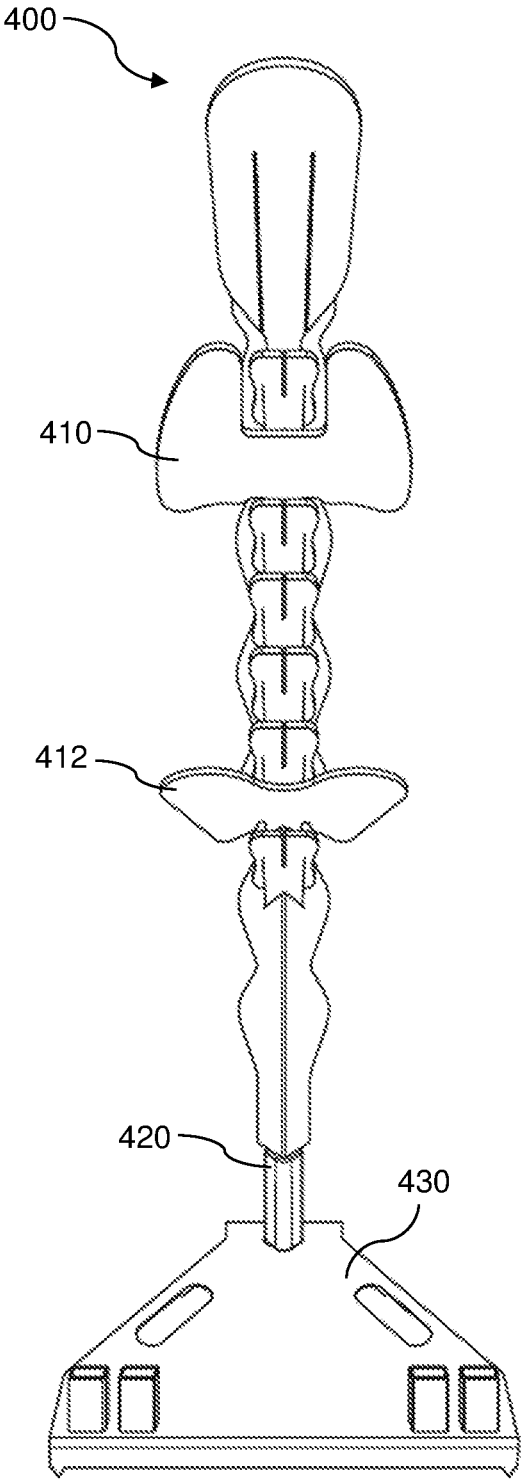
FIG. 4 shows a shooting target system, in accordance with a representative embodiment.

FIG. 4 shows a shooting target system, in accordance with a representative embodiment. The system 400 may be the same or similar to one or more of the systems described above, i.e., having a plurality of target regions where striking a structure of the shooting target with a projectile within different target regions creates different sounds to provide useful audio feedback to a user such as a shooter or spotter. Specifically, the system 400 may include a base 430 and a stand 420 (e.g., a post) having designated areas (e.g., slots, grooves, or the like) for receiving one or more plates. More specifically, the system 400 may include: a first plate 410 disposed within at least a first slot of the plurality of slots of the stand 420, where the first plate 410 is structurally configured to resonate and create a first sound when struck by a projectile; and a second plate 412 disposed within a second slot of the plurality of slots of the stand 420, where the second plate 412 is structurally configured to resonate and create a second sound when struck by a projectile. As described herein, each of the first sound and the second sound may be within a range of human hearing, where the second sound is audibly distinct to a human from the first sound.

Figure 5:
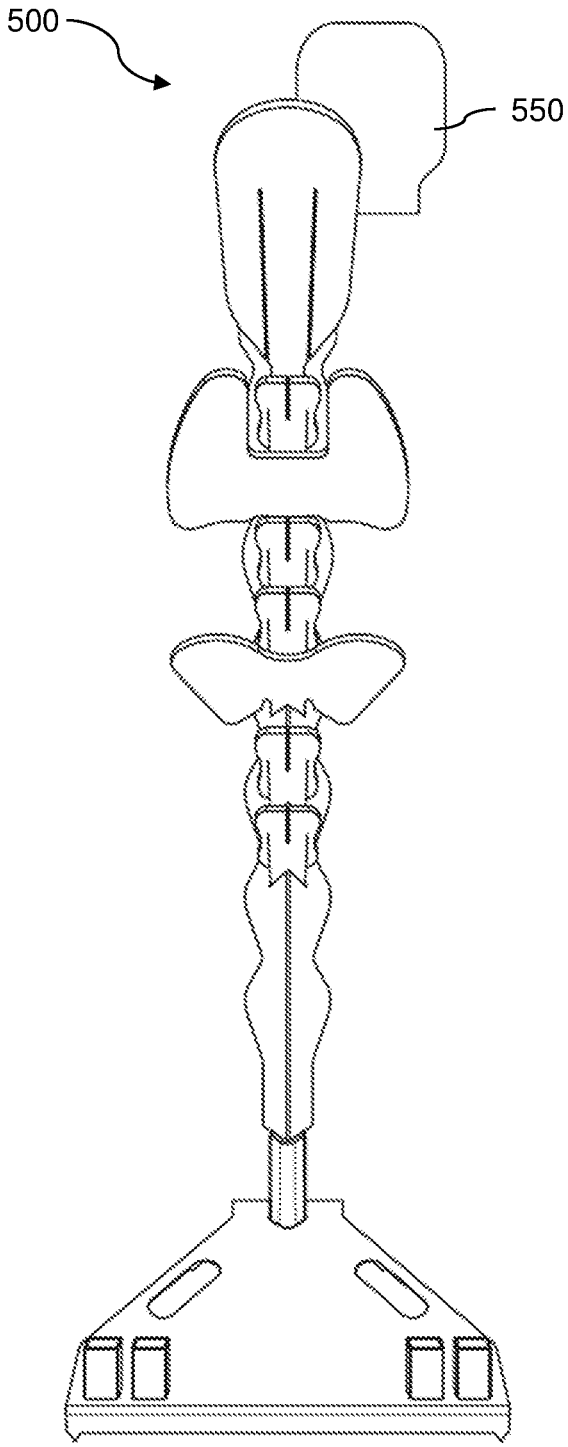
FIG. 5 shows a shooting target system with an ancillary target, in accordance with a representative embodiment.

FIG. 5 shows a shooting target system with an ancillary target, in accordance with a representative embodiment. The system 500 may be the same or similar to one or more of the systems described above, e.g., the system 400 of FIG. 4, but where the system 500 of FIG. 5 further includes an ancillary target plate 550. As shown in the system 500, the ancillary target plate 550 may be in the form of a hostage-taker style target, which can be structurally configured to rotate or otherwise move when struck by a projectile. As described herein, the ancillary target plate 550 may also or instead be structurally configured to resonate and create a distinct sound when struck by a projectile.

Figure 6:
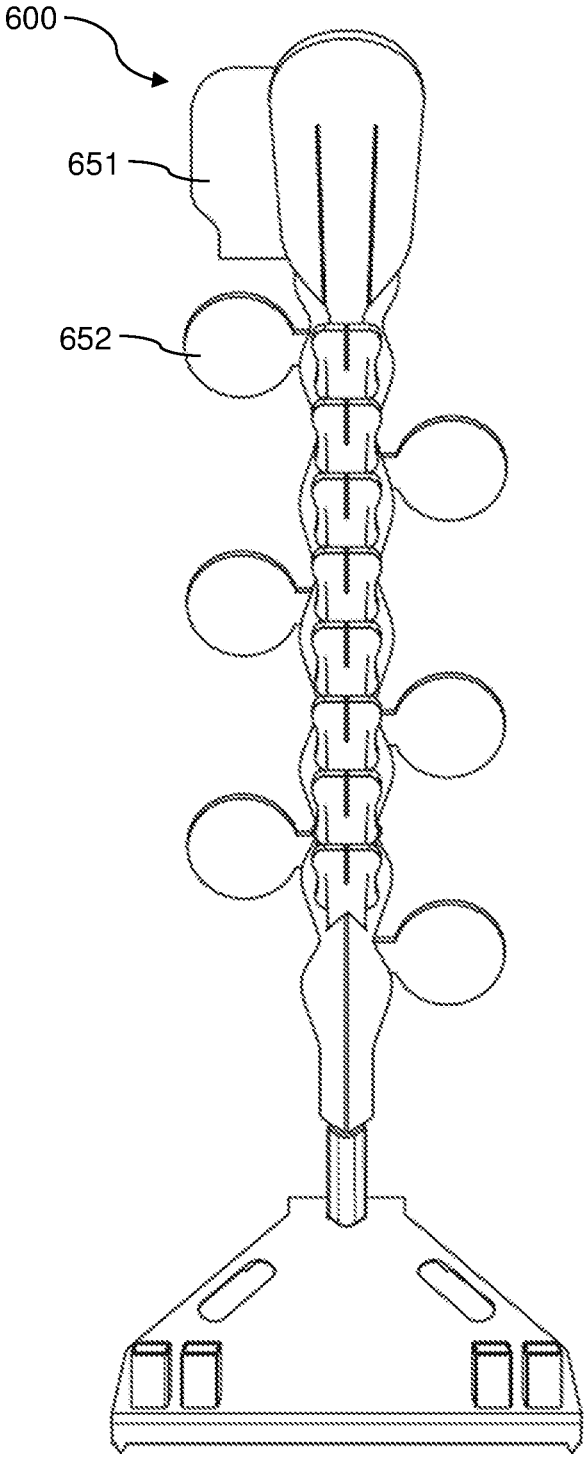
FIG. 6 shows a shooting target system with a plurality of ancillary targets, in accordance with a representative embodiment.

FIG. 6 shows a shooting target system with a plurality of ancillary targets, in accordance with a representative embodiment. The system 600 may be the same or similar to one or more of the systems described above, e.g., the system 500 of FIG. 5, but where the system 600 of FIG. 6 further includes a plurality of ancillary target plates. For example, as shown in the system 600, the plurality of ancillary target plates may include one or more first ancillary target plates 651 (which may be in the form of one or more hostage-taker style targets or the like) and one or more second ancillary target plates 652 (which may be in the form of one or more shooting-tree style targets, challenge targets, game targets, movable targets, or the like). One or more of the ancillary target plates may be structurally configured to rotate when struck by a projectile. Further, as described herein, one or more of the ancillary target plates may be structurally configured to resonate and create a distinct sound when struck by a projectile. Also, as shown in FIG. 6, the system 600 may include plates as described herein that are structurally configured to be removable and replaceable within the system 600. Thus, as shown in the figure, one or more of these plates may be removed when the system 600 is configured for a user to focus on striking the ancillary targets.

Figure 7:
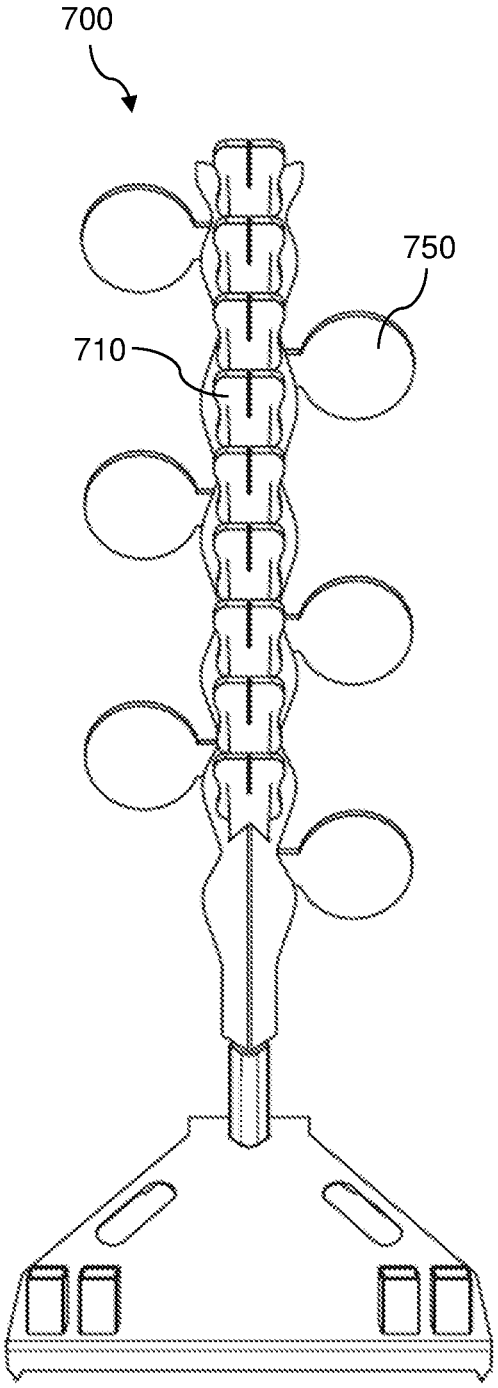
FIG. 7 shows a shooting target system with a plurality of ancillary targets, in accordance with a representative embodiment.

FIG. 7 shows a shooting target system with a plurality of ancillary targets, in accordance with a representative embodiment. The system 700 may be the same or similar to one or more of the systems described above, e.g., the system 600 of FIG. 6, but where the system 700 of FIG. 7 merely includes ancillary target plates 750 in the form of a shooting tree target or the like. The system 700 may also or instead include plates 710 similar to those described herein (target plates structurally configured to resonate and create a distinct sound when struck by a projectile), e.g., plates 710 that mimic anatomy in the form of a portion of a spinal region or the like.

Figure 8:
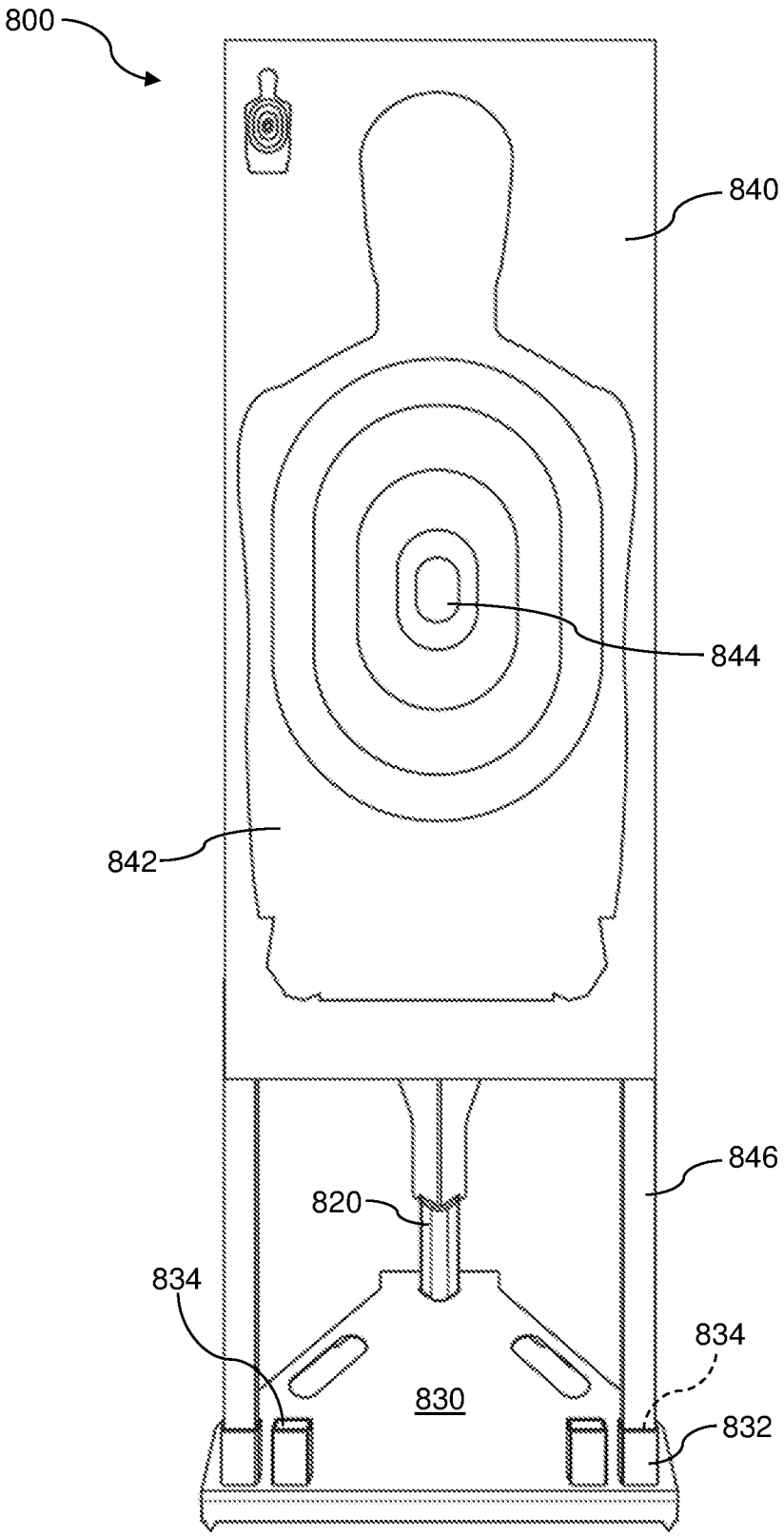
FIG. 8 shows a shooting target system with a second target, in accordance with a representative embodiment.

FIG. 8 shows a shooting target system with a second target, in accordance with a representative embodiment. The system 800 may be the same or similar to one or more of the systems described above, i.e., having a plurality of target regions where striking a structure of the shooting target with a projectile within different target regions creates different sounds to provide useful audio feedback to a user such as a shooter and/or spotter. As shown in the figure, the system 800 of FIG. 8 may further include a second target 840 coupled to the base 830. In particular, the second target 840 may be disposed in front of the stand 820 using a holder 832 that defines one or more voids 834 structurally configured to receive a support structure 846 of the second target 840. As shown in the figure, the second target 840 may include one or more of a silhouette 842 of an animal (in this instance, a human) and a bullseye 844 thereon.

Figure 10:
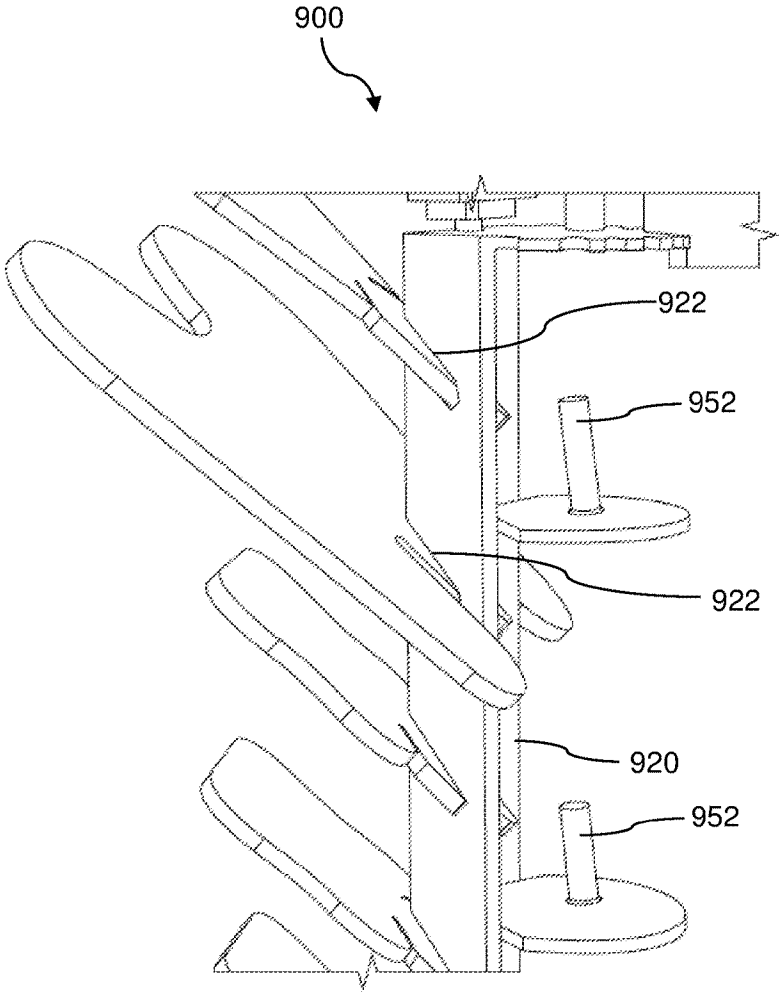
FIG. 10 shows a close-up view of a shooting target, in accordance with a representative embodiment.
Figure 9:
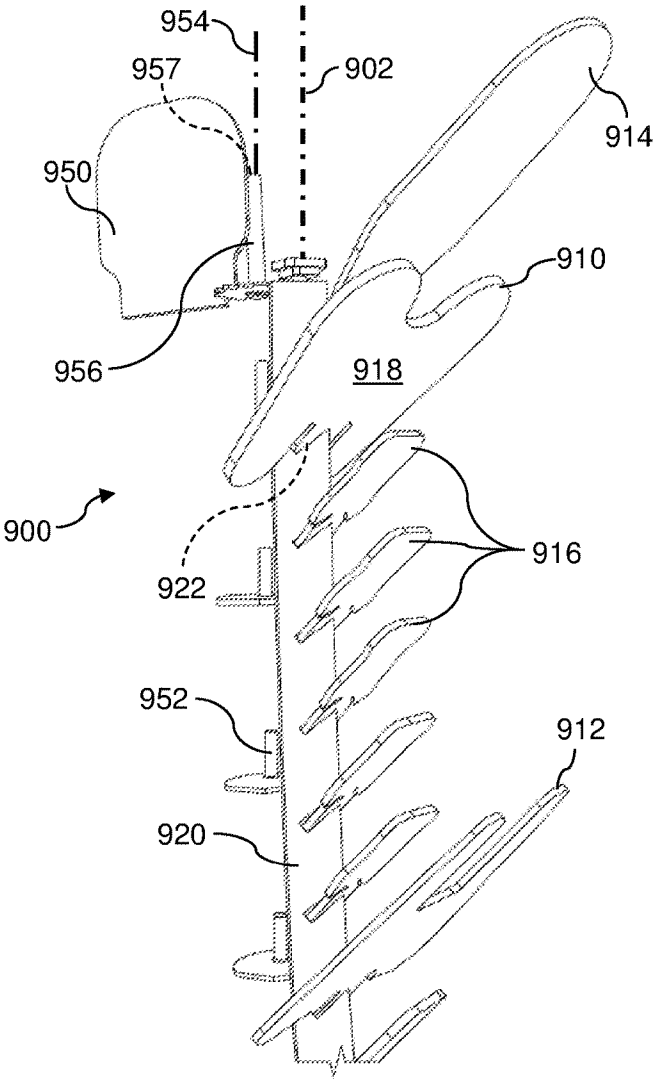
FIG. 9 shows a top portion of a shooting target, in accordance with a representative embodiment.

FIG. 9 shows a top portion of a shooting target and FIG. 10 shows a close-up view of the shooting target of FIG. 9, in accordance with a representative embodiment. The shooting target 900 may be the same or similar to others included herein, including a plurality of plates—e.g., a first plate 910 mimicking lungs, a second plate 912 mimicking a pelvis, a third plate 914 mimicking a head, and a plurality of fourth plates 916 mimicking portions of a spine of an animal—where one or more of the plurality of plates are structurally configured to resonate and create a distinct sound when struck by a projectile. For example, the sound created by the first plate 910, the second plate 912, the third plate 914, and the plurality of fourth plates 916 may each be different and discernable to a human user. In certain aspects, the plates of the shooting target can include a group of plates that sound substantially the same to a human when struck by a projectile. For example, each of the plurality of fourth plates 916 may all sound substantially the same to a human when struck by a projectile.

The shooting target 900 of FIGS. 9 and 10 also clearly shows supports 952 that can be used for supporting one or more ancillary target plates 950 or the like. For example, in certain aspects, a support 952 can include a post that engages with a void 957 defined by the engagement structure 956 of an ancillary target plate 950. The engagement of the ancillary target plates 950 and the supports 952 may facilitate removal and replacement (e.g., reconfiguring) of the ancillary target plates 950 along the shooting target 900. Further, in certain aspects, an ancillary target plate 950 may be moved about the support 952, e.g., about a rotation axis 954 defined by the support 952. To this end, the engagement structure 956 of an ancillary target plate 950 may include a hollow cylinder or the like that receives the support 952 (e.g., post) in a manner that facilitates rotation of the ancillary target plate 950 about the engagement structure 956. Other mechanical arrangements are also or instead possible for the coupling (e.g., removable and replaceable coupling, and/or where the coupling can facilitate movement of the ancillary target plate 950) of an ancillary target plate 950 to the shooting target 900 such as a hinge or the like.

The shooting target 900 of FIGS. 9 and 10 also clearly shows how the stand 920 may define one or more slots 922 (or other voids, or the like) to facilitate removable and replaceable engagement with one or more plates of the shooting target 900. For example, as shown in FIG. 9, each of the first plate 910, the second plate 912, the third plate 914, and the plurality of fourth plates 916 may each be disposed within a slot 922 of the stand 920. Further, in some aspects, one or more of the plurality of slots 922 may be structurally configured such that, when a plate is disposed therein, the plate has a front surface 918 that is disposed at an angle relative to a central axis 902 that traverses through the stand 920. To this end, the slots 922 may define angled grooves or the like that can be cut into, or otherwise formed on the stand 920. As described herein, angling the plates may be advantageous to deflect projectiles striking the plates toward the ground or otherwise to deflect projectiles for safety. By way of example, the angle of a plate may be substantially between about 32 and about 42 degrees, inclusive. Other angles are also or instead possible as will be understood by a skilled artisan.

Thus, as described herein, the present teachings may include a shooting target 900 or target system that includes target regions and/or target plates (or other portions) that are angled downward toward a resting surface (e.g., the ground), where these angled surfaces can provide for the deflection of projectiles striking the target 900 for safety. For example, an aspect includes target plates that may be disposed at angles including and/or between about 32 and about 42 degrees relative to an axis normal to the resting surface (e.g., the central axis 902 that traverses through the stand 920). Such angled target surfaces may allow for a shooter to get closer to the target 900 than with existing target systems. For example, in some existing target systems that include steel targets and the like, a safe minimal shooting distance from the target may be about 15 to 20 yards with a pistol (13.7 to 18.3 meters), and 100 to 120 yards (91.5 to 110 meters) with long a long gun (e.g., AR15, SKS, .308 rifle, and the like). Using an aspect of the present teachings with angled target surfaces, however, much closer distances can be possible. For example, with certain aspects of the present teachings that include steel targets with angled target surfaces, a safe minimal shooting distance from the target may be about 5 to 7 yards (4.6 to 6.4 meters) with a pistol and about 20 yards (18.3 meters) for long guns. Angled target surfaces can also or instead improve the life span of the material (e.g., steel) used for the target 900.

Figure 11:
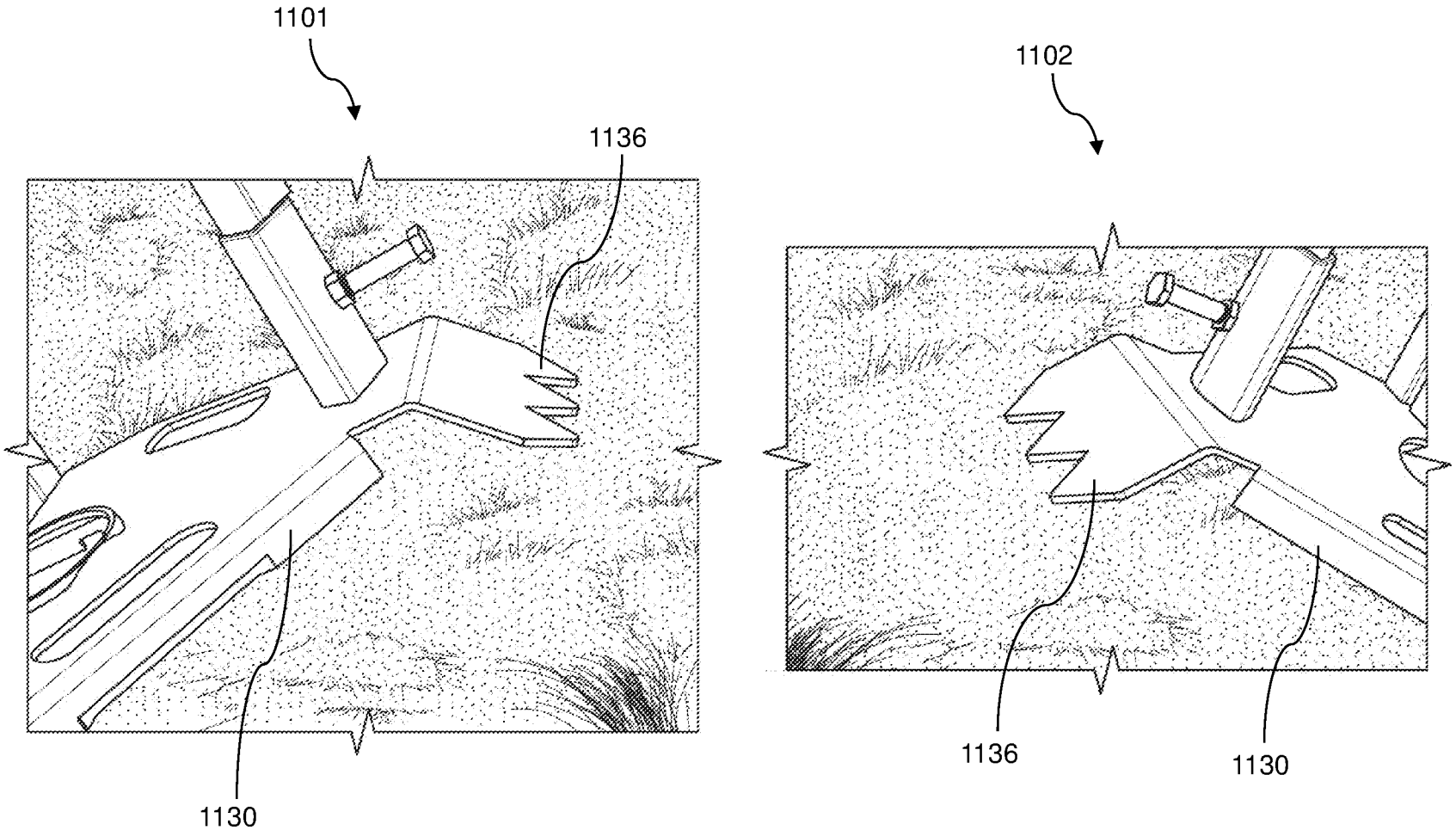
FIG. 11 shows views of a base for a shooting target, in accordance with a representative embodiment.

FIG. 11 shows views of a base for a shooting target, in accordance with a representative embodiment. Specifically, the figure includes a right side view 1101 and a left side view 1102 of a rear portion of an example of a base 1130 for a shooting target, which may be any of the shooting targets or shooting target systems described herein. As shown in the figure, the base 1130 may include one or more teeth 1136 or the like disposed thereon, where these teeth 1136 are structurally configured to secure the base 1130 in the ground (or another resting surface) at a substantially fixed location. That is, the teeth 1136 may be structurally configured to dig into dirt, grass, sand, gravel, and the like, in order to secure the base 1130 at a designated location at least temporarily. Other mechanical structures may also or instead be included on the base 1130 to assist in this effort, including posts, pins, bolts, cables, tie-downs, and the like.

Figure 12:
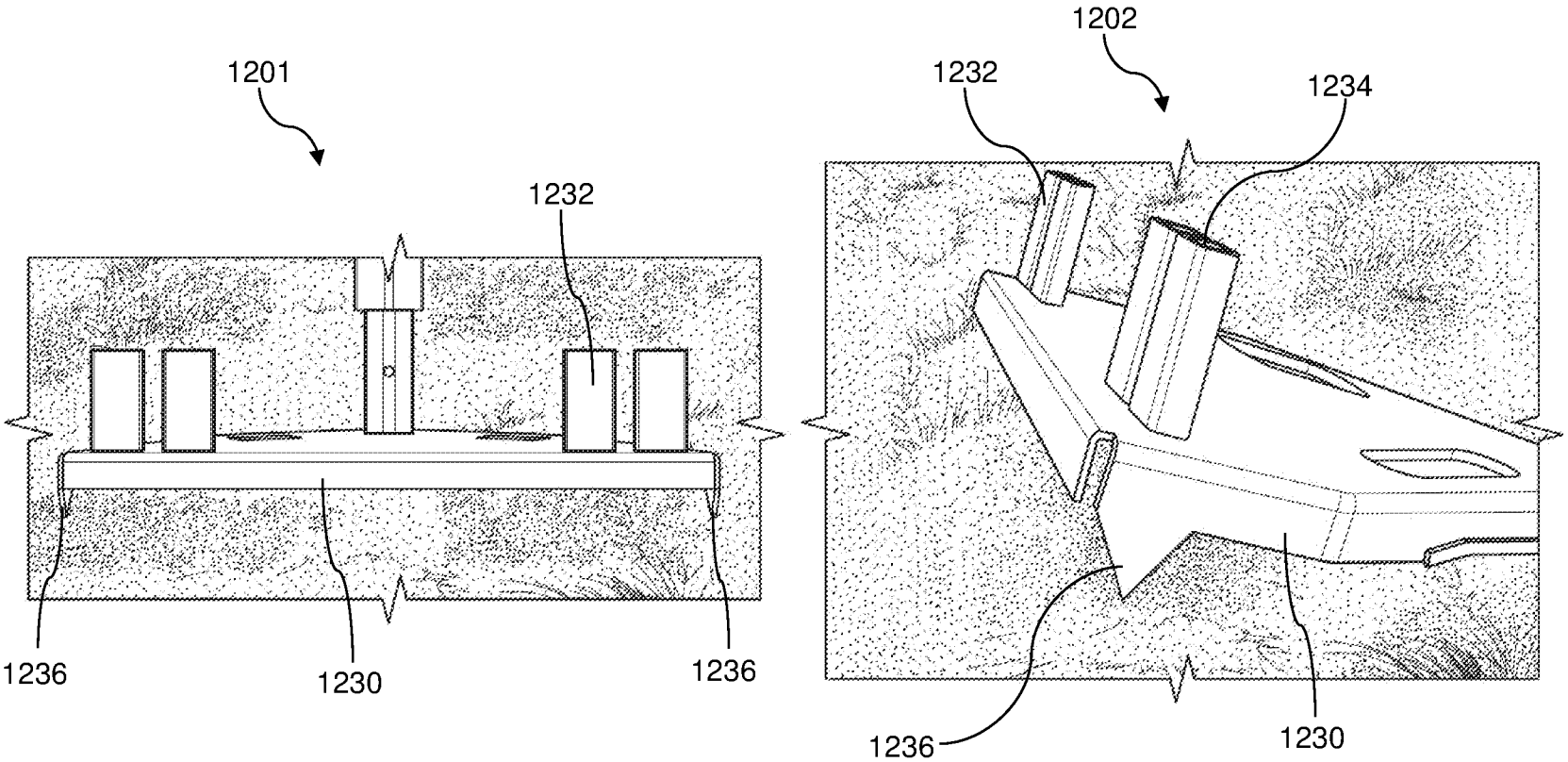
FIG. 12 shows views of a base for a shooting target, in accordance with a representative embodiment.

FIG. 12 shows views of a base for a shooting target, in accordance with a representative embodiment. Specifically, the figure includes a front view 1201 and a right side view 1202 of a front portion of an example of a base 1230 for a shooting target, which may be any of the shooting targets or shooting target systems described herein. As shown in the figure, the base 1230 may include one or more holders 1232 structurally configured to couple with at least a portion of a second target to position the second target adjacent to a shooting target supported by the base 1230. A holder 1232 may include a cavity or void 1234 that is structurally configured (e.g., sized and shaped) to receive a support structure therein. Other configurations for such a holder 1232 are also or instead possible—e.g., a holder 1232 may also or instead include one or more of a projection, a cavity (e.g., a slot or indentation), a pin, a post, a cable, a clamp, and so on. Multiple holders 1232 and types thereof may be included on a base 1230, e.g., for adaptability to different sizes and/or shapes of second targets and supports thereof.

FIG. 12 also shows an example of one or more teeth 1236 or the like that may be included on the base 1230, and more particularly a front portion of the base 1230. The teeth 1236 may be structurally configured to secure the base 1130 in the ground (or another resting surface) at a substantially fixed location. That is, the teeth 1236 may be structurally configured to dig into dirt, grass, sand, gravel, and the like, in order to secure the base 1230 at a designated location at least temporarily.

Figure 13:
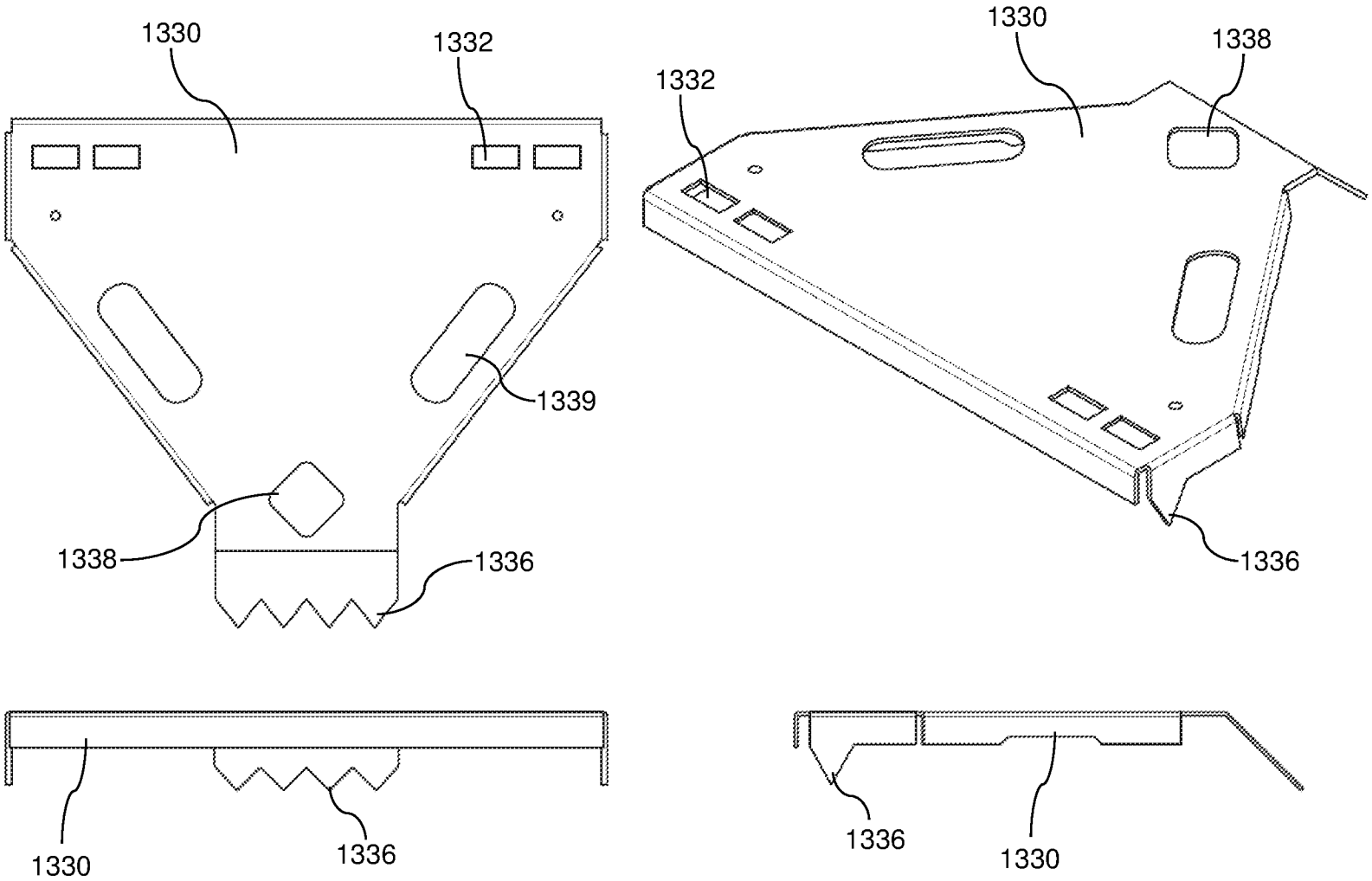
FIG. 13 illustrates various views of a base for a shooting target, in accordance with a representative embodiment.

FIG. 13 illustrates various views of a base for a shooting target, in accordance with a representative embodiment. The base 1330 may be the same or similar to any of the bases described herein. As shown in the figure, the base 1330 may include one or more of a holder 1332 for coupling and securing a second target, teeth 1336 for securing the base to a resting surface of a location, and one or more engagement portions 1338 for engaging the base to a stand of a shooting target or shooting target system. The engagement portions

1338 may include a cavity or the like in the base 1330 that is structurally configured to receive a stand therein, although other structures for the engagement portions 1338 are also or instead possible. The base 1330 may further include one or more handholds 1339 or the like, e.g., to ease transport of the base 1330 and/or a shooting target system.

Figure 14:
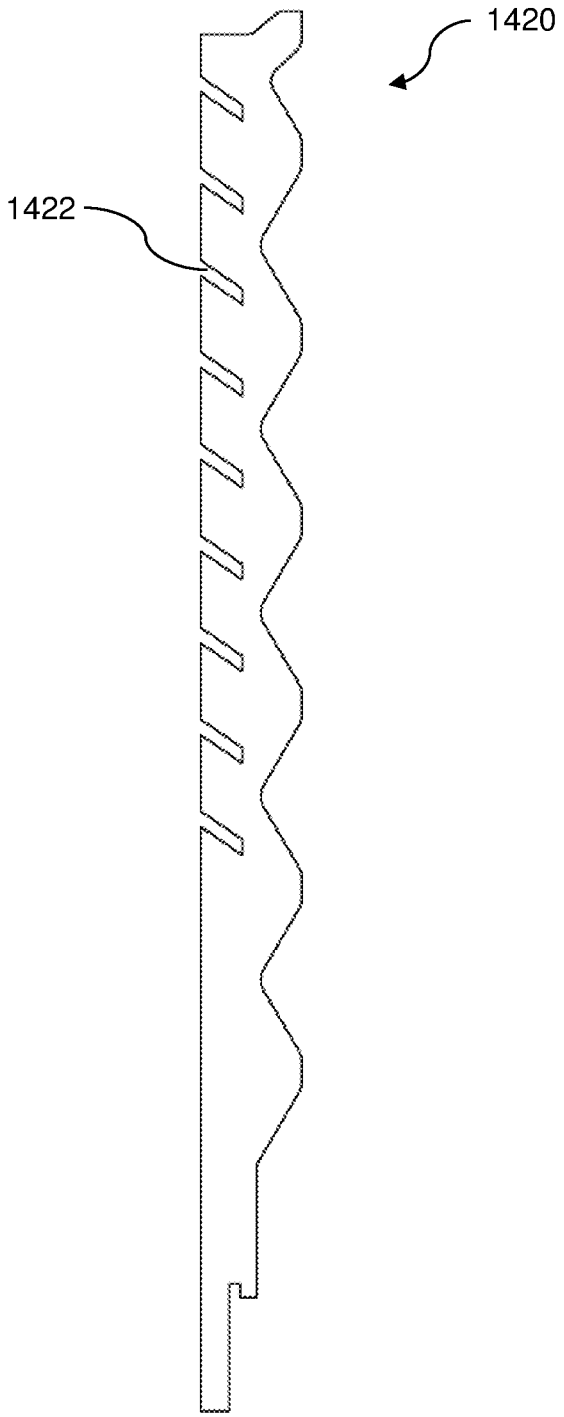
FIG. 14 illustrates a stand for a shooting target, in accordance with a representative embodiment.

FIG. 14 illustrates a stand for a shooting target, in accordance with a representative embodiment. The stand 1420 may be the same or similar to any as described herein. As such, the stand 1420 may include a plurality of slots 1422 therein or thereon, where the slots 1422 are structurally configured for receiving one or more plates such that the plates are secured to the stand 1420, but are also removable and replaceable on the stand 1420.

Figure 15:
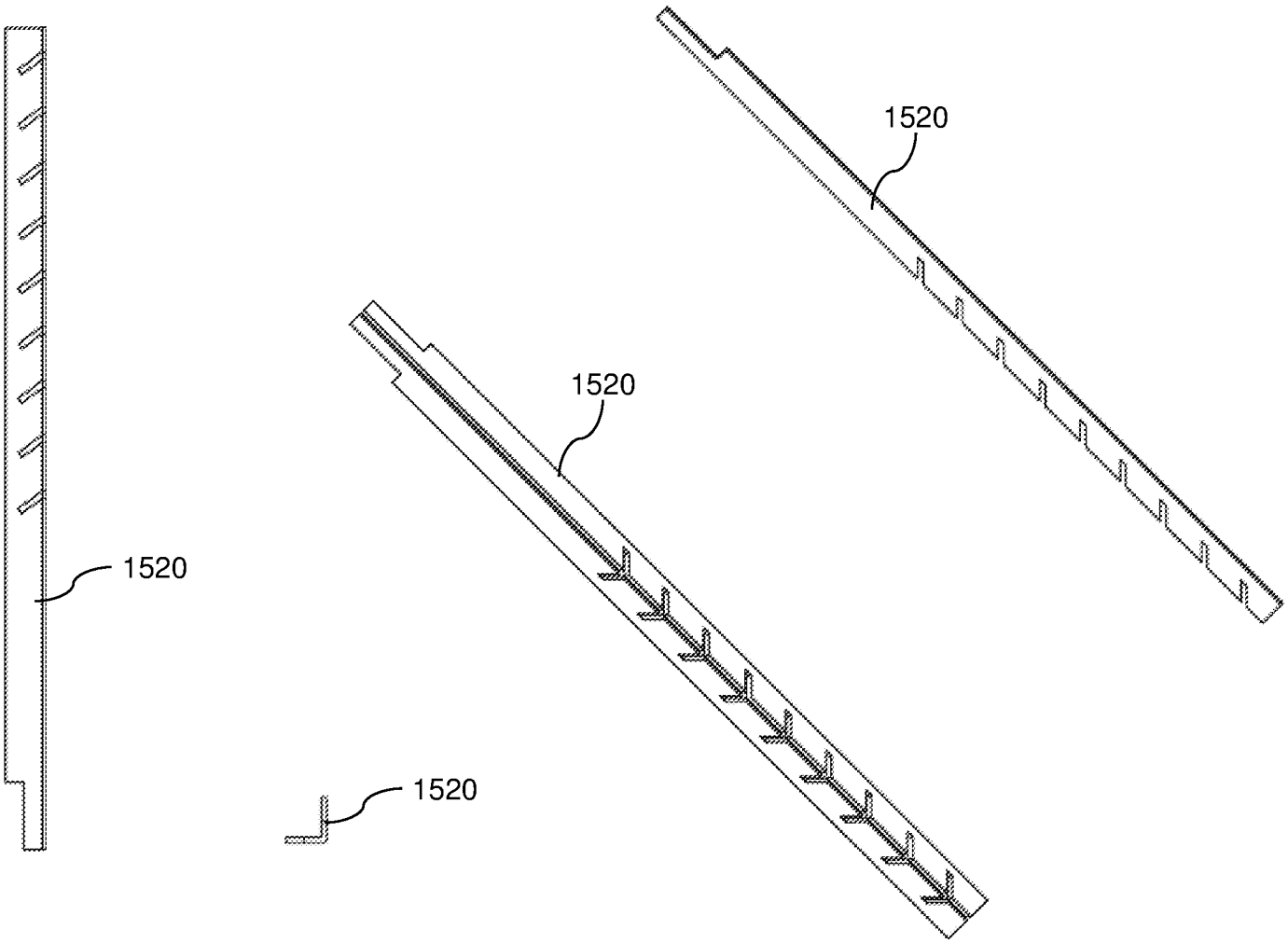
FIG. 15 illustrates various views of a stand for a shooting target, in accordance with a representative embodiment.

FIG. 15 illustrates various views of a stand for a shooting target, in accordance with a representative embodiment. The stand 1520 may be the same or similar to any as described herein. For example, the stand 1520 of FIG. 15 may be similar to that described above with reference to FIG. 14, but it may have a slightly different shape.

Figure 18:
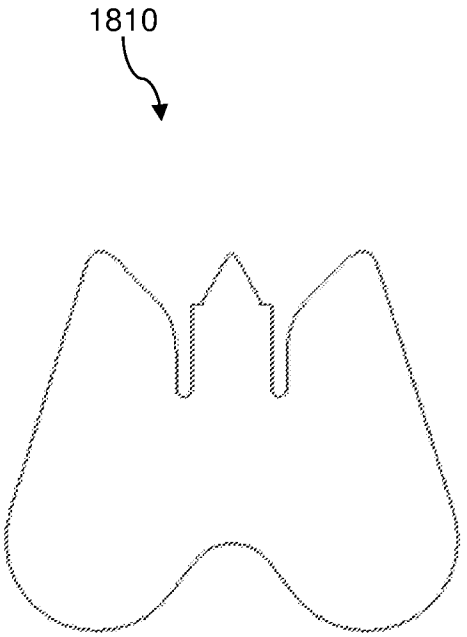
FIG. 18 illustrates a plate for a shooting target that mimics a pelvis, in accordance with a representative embodiment.
Figure 17:
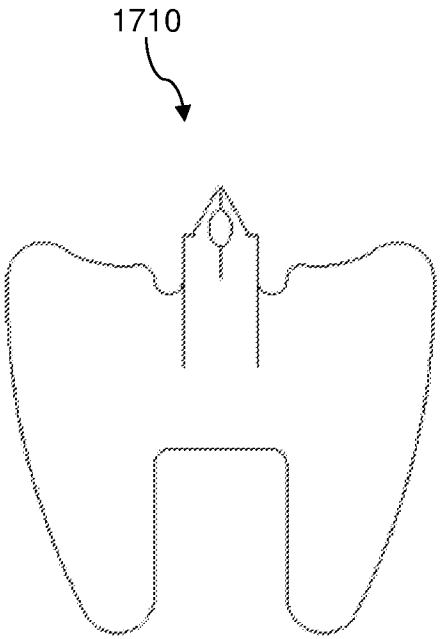
FIG. 17 illustrates a plate for a shooting target that mimics lungs, in accordance with a representative embodiment.
Figure 16:
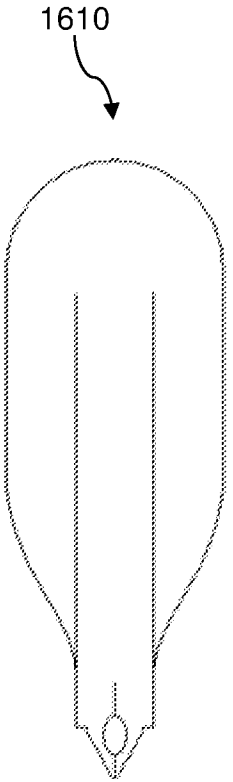
FIG. 16 illustrates a plate for a shooting target that mimics a head, in accordance with a representative embodiment.

FIGS. 16-18 illustrate various examples of plates for a shooting target, which may be the same or similar to any of the plates described herein. Specifically, FIG. 16 illustrates a plate 1610 for a shooting target that mimics a head, FIG. 17 illustrates a plate 1710 for a shooting target that mimics lungs, and FIG. 18 illustrates a plate 1810 for a shooting target that mimics a pelvis, in accordance with a representative embodiment. Other shapes for the plates are also or instead possible as will be understood by a skilled artisan.

Figure 19:
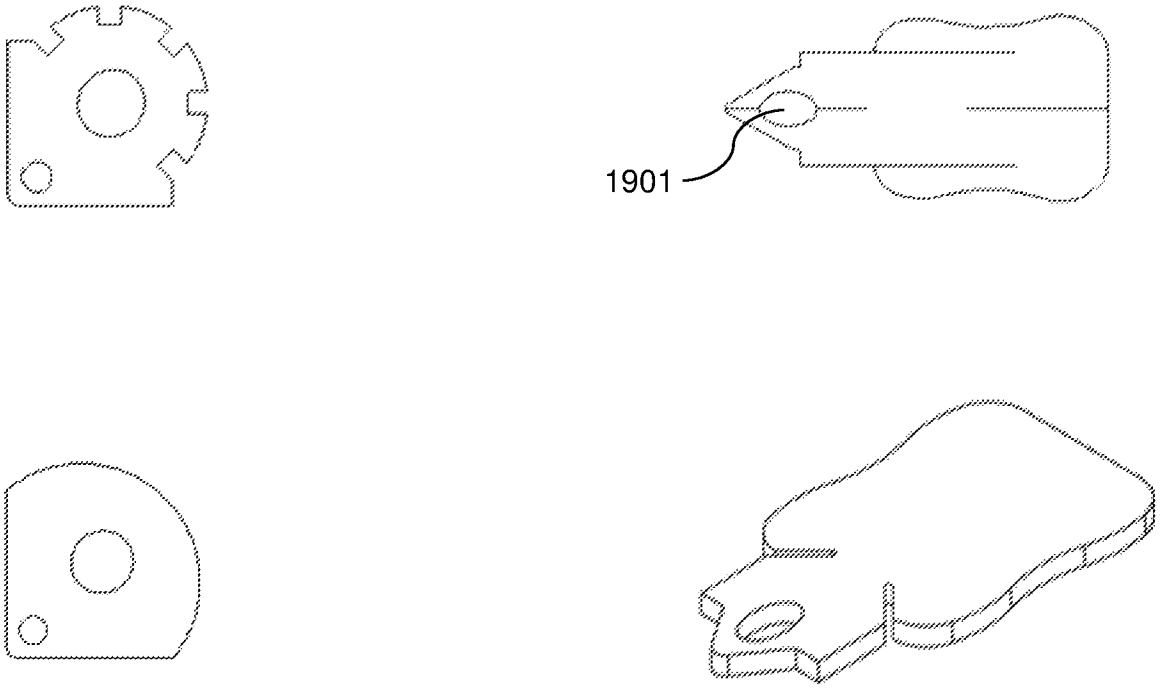
FIG. 19 illustrates various plates for a shooting target that mimic portions of a spine, in accordance with representative embodiments.

FIG. 19 illustrates various plates for a shooting target that mimic portions of a spine, in accordance with representative embodiments. The plates shown here may be the same or similar to any of the plates described herein. In particular, the plates of FIG. 19 may mimic portions of a spine of an animal. As shown in this figure, one or more of the plates may include a hole 1901 or the like, which can be utilized for securing a plate in place on the stand of a shooting target or shooting target system. That is, the hole 1901 may be part of a locking mechanism (e.g., in conjunction with a pin or the like) for securing a plate to the stand of a shooting target. Other forms of locking mechanisms for mechanically securing the plates to a stand may also or instead be included.

Figure 20:
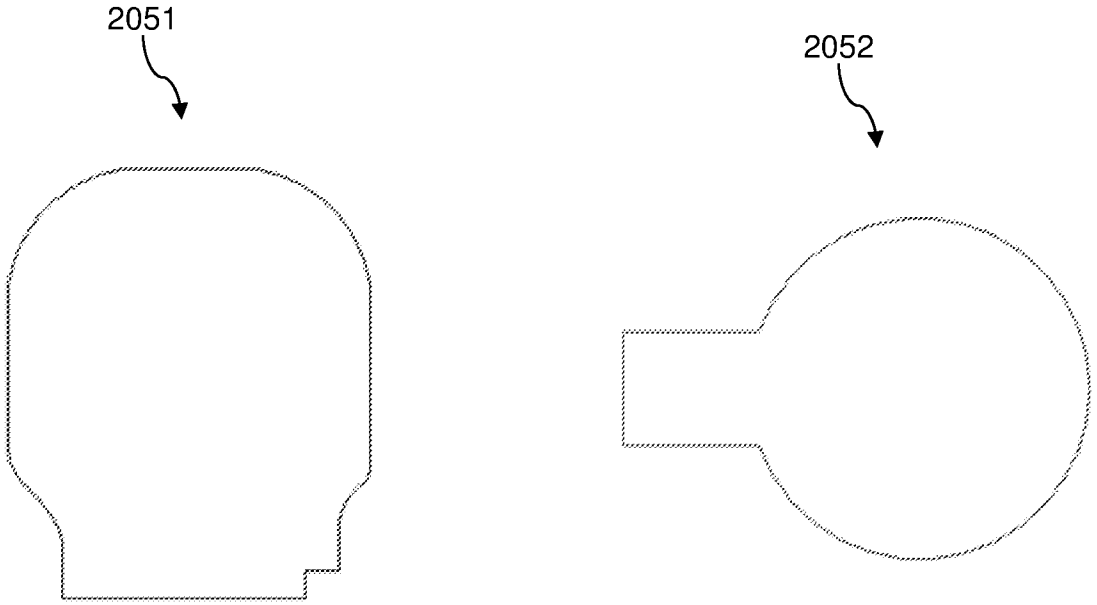
FIG. 20 illustrates various ancillary targets for a shooting target, in accordance with representative embodiments.

FIG. 20 illustrates various ancillary targets for a shooting target, in accordance with representative embodiments. The ancillary targets shown here may be the same or similar to any of the ancillary targets described herein. For example, FIG. 20 shows a first ancillary target plate 2051 in the form of a hostage-taker style target, and a second ancillary target plate 2052 in the form of a shooting tree or shooting challenge style target.

Figure 21:
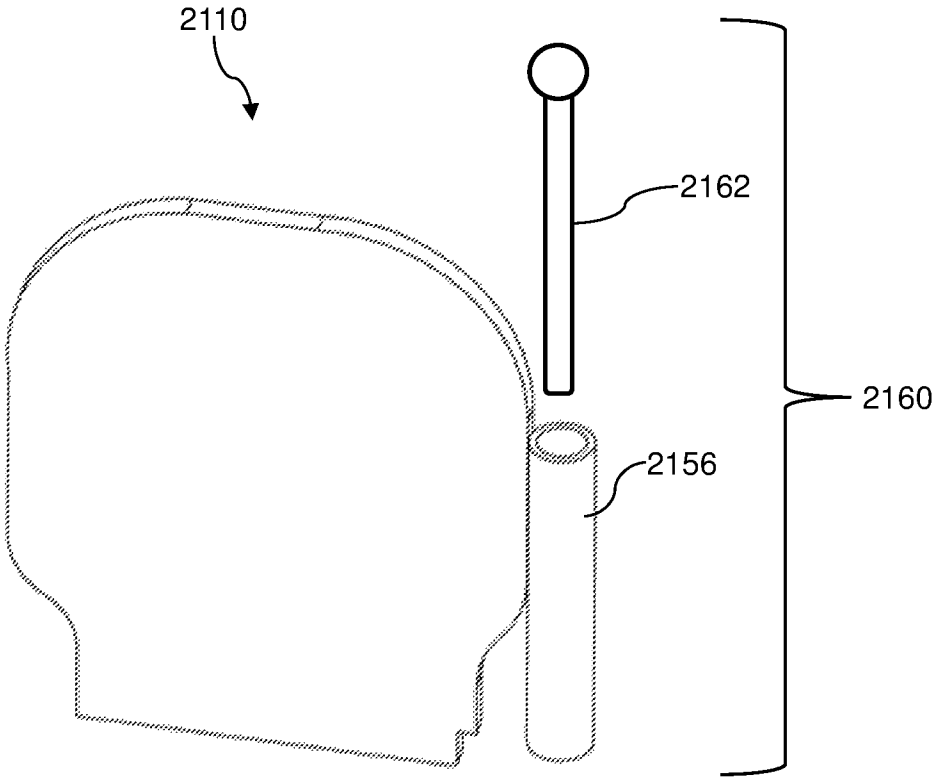
FIG. 21 illustrates a plate for a shooting target, in accordance with a representative embodiment.

FIG. 21 illustrates a plate for a shooting target, in accordance with a representative embodiment. Specifically, this figure shows one example of a locking mechanism 2160 that can be used to secure a plate 2110 to a stand of a shooting target. In particular, the plate 2110 may be a hostage-taker style plate that is configured to rotate or otherwise move relative to a stand of a shooting target to which it is secured, and, to this end, the locking mechanism 2160 may double as a mechanism that secures the plate 2110 to the stand and provides for such movement. That is, the locking mechanism 2160 may include an engagement structure 2156 such as a hollow cylinder or the like that receives a support (e.g., a post) on the stand in a manner that facilitates rotation of the plate 2110 about the engagement structure 2156. Further, this engagement structure 2156 may be secured to the stand via a locking pin 2162 or the like that engages with one or more of the engagement structure 2156 and at least a portion of the stand (e.g., a cavity, hole, or indentation in the stand). In other implementations, the locking pin 2162 or the like may be integral with the engagement structure 2156, i.e., not a separate piece. In such implementations, it will be understood that the engagement structure 2156 would not be in the form of a hollow cylinder. Other mechanical arrangements are also or instead possible for the coupling (e.g., removable and replaceable coupling, and/or where the coupling can facilitate movement of a plate 2110) of a plate 2110 to a shooting target 900 as will be understood by a skilled artisan.

Figure 22:
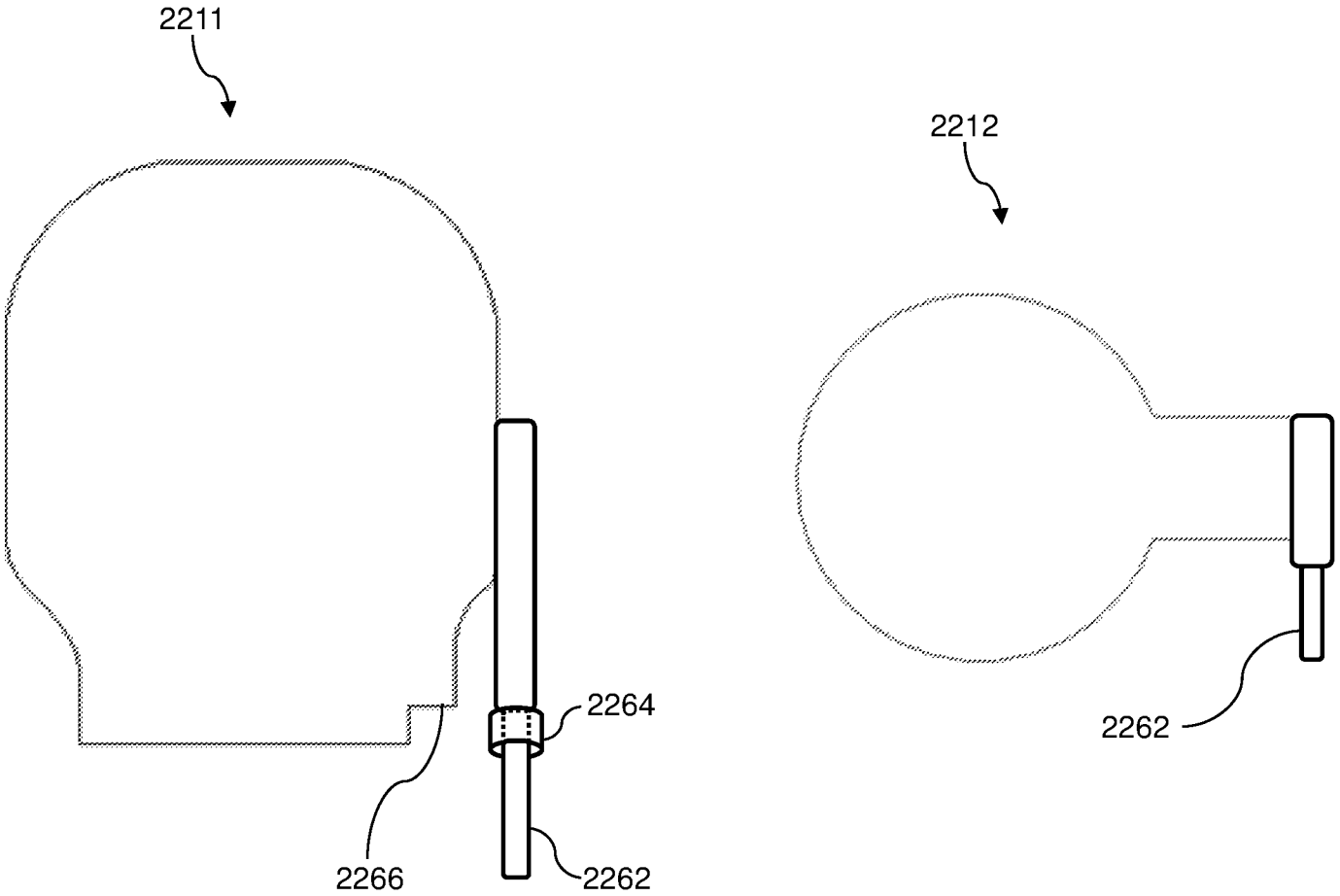
FIG. 22 illustrates various ancillary targets for a shooting target, in accordance with representative embodiments.

For example, FIG. 22 illustrates various ancillary targets for a shooting target, in accordance with representative embodiments, which may include another implementation for engaging with a stand or the like of a shooting target. Specifically, the figure shows a first ancillary target plate 2211 (e.g., a hostage-taker style plate) and a second ancillary target plate 2212 (e.g., a shooting-tree style target plate) that each include a pin 2262 or the like for engaging with a stand or the like of a shooting target. For example, a stand or another structure of a shooting target may include a hole, cavity, void, and/or indentation that is structurally configured to receive the pin 2262 therein. The pin 2262 and the cooperating void or the like on the structure of a shooting target may be structurally configured to permit a predetermined movement of the plate—e.g., full rotation, partial rotation, rotation between predetermined positions (e.g., where each round that hits the plate is configured to move the plate a predetermined amount), other movement besides rotation, and so on. The pin 2262 and the cooperating void or the like on the structure of a shooting target may also or instead be structurally configured to prevent movement of the plate relative to the shooting target, i.e., to maintain the plate in one or more substantially fixed positions.

In some implementations, an adapter 2264 can be provided to place a plate in a predetermined configuration relative to the shooting target. For example, the adapter 2264 may function as a bearing or the like that allows for movement of the plate relative to a structure of the shooting target. The adapter 2264 may also or instead function as a spacer or the like, that can place a feature 2266 of the plate in a predetermined position relative to a structure of the shooting target. For example, the feature 2266 of the plate may include one or more of a specific size or shape of one or more of an indentation, a cutout, a projection, or the like. And when the feature 2266 of the plate is placed in a predetermined position relative to a cooperating structure of the shooting target (e.g., a portion of the stand as described herein), this may provide for one or more of a predetermined positioning, alignment (e.g., angle of the plate), movement, locking, and so on, of the plate. By way of example, when the adapter 2264 is included in an implementation, this may allow for rotation of the plate, and when the adapter 2264 is not included, this may fix a position of the plate relative to a structure of the shooting target (e.g., via the feature 2266 being secured within, or otherwise engaging with, a cooperating structure of the shooting target). One skilled in the art will understand that other configurations are also or instead possible.

Figure 23:
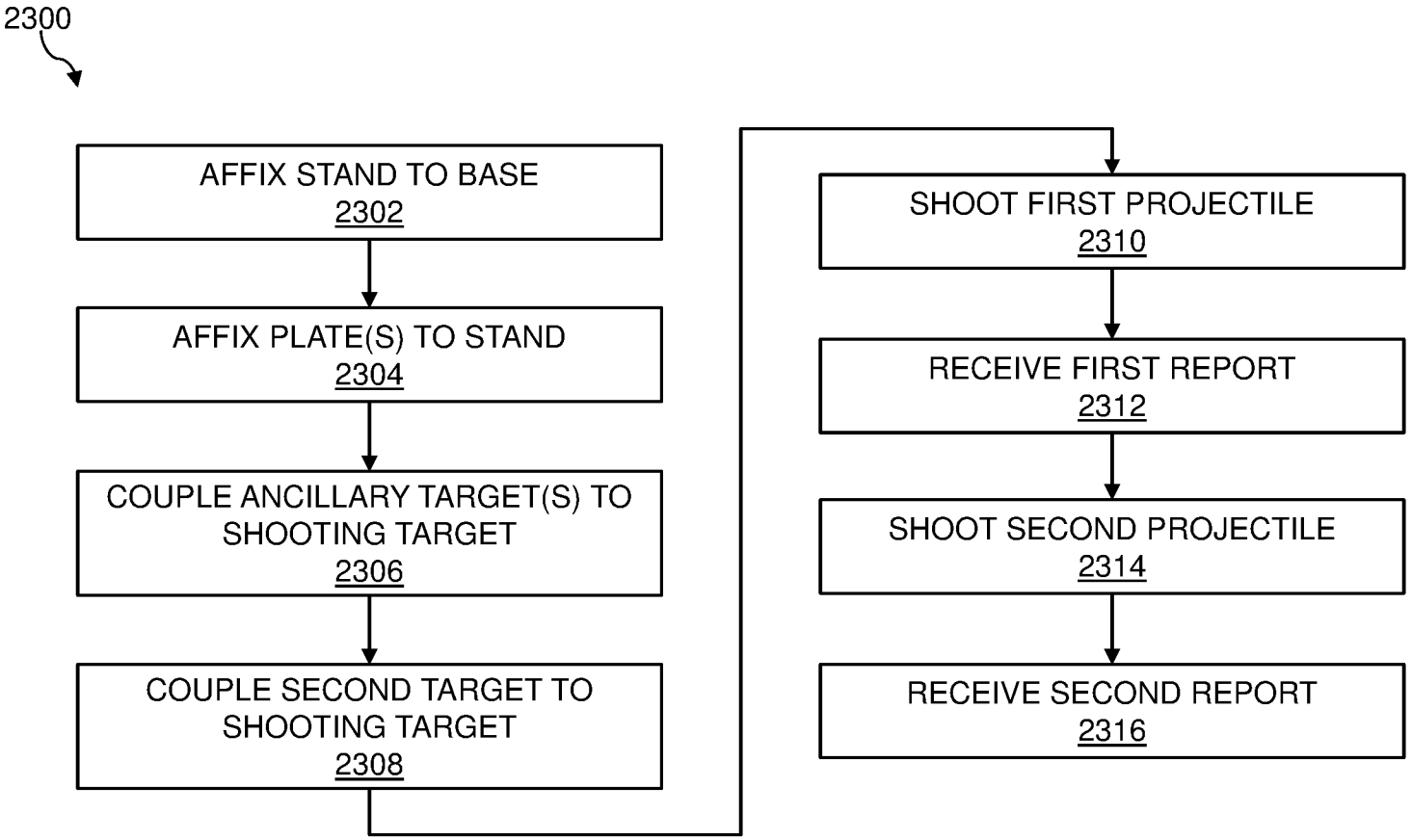
FIG. 23 is a flow chart of a method of using a shooting target and target system, in accordance with a representative embodiment.

FIG. 23 is a flow chart of a method of using a shooting target and target system, in accordance with a representative embodiment. The method 2300 may be performed using any of the devices and systems described herein, such as any of those described above with reference to FIGS. 1-22.

As shown in step 2302, the method 2300 may include affixing a stand of a shooting target to a base. This may include simply aligning a stand with the base in a predetermined manner. For example, the base may include a hole or void structurally configured to receive the stand therein, e.g., via a friction fit or the like, or simply held in due to gravity and the weight of the stand. Also or instead, the base may include a projection and the stand may include a void, where the void in the stand is structurally configured to receive the projection of the base (or vice-versa).

As shown in step 2304, the method 2300 may include affixing one or more plates as described herein to the stand (or another portion of the structure of a shooting target). For example, this step 2304 may include affixing a first plate and a second plate to the stand, where the first plate is structurally configured to resonate and create a first sound when struck by a projectile and the second plate is structurally configured to resonate and create a second sound when struck by the projectile. As discussed herein, each of the first sound and the second sound may be within a range of human hearing, where the second sound is audibly distinct to a human from the first sound.

As shown in step 2306, the method 2300 may include coupling one or more ancillary targets to the stand (or another portion of the structure of a shooting target). These ancillary targets may be any as described herein.

As shown in step 2308, the method 2300 may include coupling a second target to one or more of the base and the stand (or another portion of the structure of a shooting target). The second target may be any as described herein, for example including one or more of a silhouette of an animal and a bullseye thereon. Also or instead, this step 2308 may simply include placing the second target in-between a shooter and the shooting target, e.g., with or without securing it to the shooting target.

As shown in step 2310, the method 2300 may include shooting a first projectile and striking the first plate to create the first sound.

As shown in step 2312, the method 2300 may include receiving a first report including the first sound indicating that the first plate has been struck by the first projectile.

As shown in step 2314, the method 2300 may include shooting a second projectile and striking the second plate to create the second sound. The first projectile and the second projectile may be the same type of bullet fired from a firearm (e.g., the same caliber bullet fired from the same or a similar firearm).

As shown in step 2316, the method 2300 may include receiving a second report including the second sound indicating that the second plate has been struck by the second projectile.

By way of example, it will be understood that the present teachings may be used by tactical personnel (e.g., for tactical training), snipers, police, military, militia, competition, sport, recreation, home use, and so on. The present teachings may provide a user with a challenge, improve a user's accuracy and shot placement, and so on. The present teachings may be relatively anatomically accurate compared to existing targets. The present teachings may be easy to set up and take down, as well as to transport. The present teachings may include industrial and military grade parts.

Disclaimer and Safety Recommendations

Shooters and spectators should always follow safety precautions and wear proper eye and hearing protection. Additionally, shooters and spectators should always follow the recommended safe distances when shooting at steel targets (e.g., 10 or more yards with standard lead/copper pistol rounds, 100 yards for rifle rounds). These distances may also help the longevity and quality of steel targets. A user should not use a shooting target that has been deformed or damaged. Users generally assume all responsibility for the use and misuse of shooting targets.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A shooting target, comprising:

a first target region including a first plate, the first plate structurally configured to resonate and create a first sound when struck by a projectile;

a second target region distinct from the first target region and including a second plate, the second plate structurally configured to resonate and create a second sound when struck by the projectile, wherein each of the first sound and the second sound are within a range of human hearing, and wherein the second sound is audibly distinct to a human from the first sound;

a stand including a plurality of slots structurally configured for receiving one or more of the first plate and the second plate therein, wherein one or more of the first plate and the second plate are removable and replaceable within one or more of the plurality of slots for reconfiguring the shooting target, and wherein the plurality of slots are structurally configured such that, when a plate is disposed therein, the plate has a front surface disposed at an angle relative to a central axis that traverses through the stand to deflect projectiles striking the plate toward a resting surface for the shooting target; and a base couplable with the stand for stabilizing the shooting target, the base including a holder disposed thereon, the holder structurally configured to couple to at least a portion of a second target in a manner that positions the second target in-between a shooter and the stand featuring the first plate and the second plate.

2. The shooting target of claim 1, wherein one or more of the first plate and the second plate is structurally configured to mimic anatomy of an animal through one or more of shape and location.

3. The shooting target of claim 2, wherein the anatomy of the animal includes one or more of a vital organ of the animal, a portion of a spine of the animal, and a portion of a pelvis of the animal.

4. The shooting target of claim 1, wherein the first sound has a first frequency and the second sound has a second frequency different from the first frequency.

5. The shooting target of claim 1, wherein the first plate and the second plate are made from the same material but have different shapes to create different sounds when struck by the projectile.

6. The shooting target of claim 5, wherein the first plate and the second plate are made from steel.

7. The shooting target of claim 1, wherein the angle is between 32 and 42 degrees, inclusive.

8. The shooting target of claim 1, further comprising an ancillary target plate affixable to the stand.

9. The shooting target of claim 8, wherein the ancillary target plate is movable relative to the stand.

10. The shooting target of claim 1, further comprising a third plate structurally configured to resonate and create a third sound when struck by the projectile, wherein the third sound is audibly distinct to a human from the first sound and the second sound.

11. The shooting target of claim 10, wherein the third plate is disposed in a third target region distinct from each of the first target region and the second target region, wherein each of the first target region, the second target region, and the third target region correspond to different anatomical regions of an animal such that striking the different anatomical regions with the projectile will make different sounds providing audible feedback to a user that the user has hit a certain region with the projectile.

12. The shooting target of claim 1, wherein the stand is made of a material structurally configured to absorb impact from and deflect projectiles not striking at least one of the first target region and the second target region.

13. The shooting target of claim 1, wherein the holder defines one or more voids structurally configured to receive a support structure of the second target.

14. A shooting target system, the system comprising:

a base;

a stand affixed to the base and including a plurality of slots thereon;

a first plate disposed within at least a first slot of the plurality of slots of the stand, the first plate structurally configured to resonate and create a first sound when struck by a projectile;

a second plate disposed within a second slot of the plurality of slots of the stand, the second plate structurally configured to resonate and create a second sound when struck by a projectile, wherein each of the first sound and the second sound are within a range of human hearing, and wherein the second sound is audibly distinct to a human from the first sound;

a holder included on the base; and a second target couplable to the base via the holder to position the second target in-between a shooter and the stand featuring the first plate and the second plate.

15. The system of claim 14, wherein the second target includes one or more of a silhouette of an animal and a bullseye thereon.

16. The system of claim 14, wherein the plurality of slots are structurally configured such that, when a plate is disposed therein, the plate has a front surface disposed at an angle relative to a central axis that traverses through the stand.

17. The system of claim 14, wherein the holder defines one or more voids structurally configured to receive a support structure of the second target.

18. A method, comprising:

affixing a stand of a shooting target to a base;

affixing a first plate, a second plate, and a third plate to the stand, wherein the first plate is structurally configured to resonate and create a first sound when struck by a projectile, the second plate is structurally configured to resonate and create a second sound when struck by the projectile, and the third plate is structurally configured to resonate and create a third sound when struck by the projectile, wherein each of the first sound, the second sound, and the third sound are within a range of human hearing, wherein each of the first sound, the second sound, and the third sound are audibly distinct from one another to a human, and wherein each of the first plate, the second plate, and the third plate are disposed in different target regions corresponding to different anatomical regions of an animal such that striking the different anatomical regions with a projectile will make different sounds providing audible feedback to a user that the user has hit a certain region with the projectile;

coupling a second target to a holder disposed on the base such that the second target is positioned in-between a shooter and the stand featuring the first plate, the second plate, and the third plate;

shooting a first projectile through the second target and striking the first plate to create the first sound;

receiving a first report including the first sound indicating that the first plate has been struck by the first projectile;

shooting a second projectile through the second target and striking the second plate to create the second sound;

receiving a second report including the second sound indicating that the second plate has been struck by the second projectile;

shooting a third projectile through the second target and striking the third plate to create the third sound;

receiving a third report including the third sound indicating that the third plate has been struck by the third projectile; and moving one or more of the first plate, the second plate, and the third plate thereby reconfiguring the shooting target.

19. The method of claim 18, wherein the first projectile, the second projectile, and the third projectile are the same type of bullet fired from a firearm.

20. The method of claim 18, wherein coupling the second target to the holder includes engaging a support structure of the second target with one or more voids defined by the holder.

* * * * *